US008490686B2

(12) United States Patent
Rodgers et al.

(10) Patent No.: US 8,490,686 B2
(45) Date of Patent: Jul. 23, 2013

(54) COUPLER COMPLIANCE TUNING FOR MITIGATING SHOCK PRODUCED BY WELL PERFORATING

(71) Applicant: Halliburton Energy Services, Inc., Houston, TX (US)

(72) Inventors: John P. Rodgers, Roanoke, TX (US); Marco Serra, Winterthur (CH); Timothy S. Glenn, Dracut, MA (US); John D. Burleson, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/633,077

(22) Filed: Oct. 1, 2012

(65) Prior Publication Data

US 2013/0153295 A1 Jun. 20, 2013

Related U.S. Application Data

(63) Continuation of application No. 13/325,726, filed on Dec. 14, 2011, now Pat. No. 8,393,393.

(30) Foreign Application Priority Data

| | | |
|---|---|---|
| Dec. 17, 2010 | (WO) | PCT/US10/61104 |
| Apr. 29, 2011 | (WO) | PCT/US11/34690 |
| Aug. 8, 2011 | (WO) | PCT/US11/46955 |

(51) Int. Cl.
*E21B 43/11* (2006.01)

(52) U.S. Cl.
USPC ..... 166/55.1; 166/297; 175/2; 89/1.15; 102/308

(58) Field of Classification Search
USPC ..... 166/55.1, 297; 175/1–4.55, 4.6; 89/1.15; 102/320
See application file for complete search history.

(56) References Cited

U.S. PATENT DOCUMENTS

| | | | |
|---|---|---|---|
| 2,833,213 | A | 5/1958 | Udry |
| 2,980,017 | A | 4/1961 | Castel |

(Continued)

FOREIGN PATENT DOCUMENTS

| | | | |
|---|---|---|---|
| EP | 2065557 | A1 | 6/2009 |
| WO | 2004099564 | A2 | 11/2004 |

OTHER PUBLICATIONS

International Search Report with Written Opinion issued Mar. 22, 2011 for PCT Patent Application No. PCT/US11/029412, 9 pages.

(Continued)

*Primary Examiner* — Jennifer H Gay
(74) *Attorney, Agent, or Firm* — Smith IP Services, P.C.

(57) ABSTRACT

A method of mitigating perforating effects produced by well perforating can include causing a shock model to predict perforating effects for a proposed perforating string, optimizing a compliance curve of at least one proposed coupler, thereby mitigating the perforating effects for the proposed perforating string, and providing at least one actual coupler having substantially the same compliance curve as the proposed coupler. A well system can comprise a perforating string including at least one perforating gun and multiple couplers, each of the couplers having a compliance curve, and at least two of the compliance curves being different from each other. A method of mitigating perforating effects produced by well perforating can include interconnecting multiple couplers spaced apart in a perforating string, each of the couplers having a compliance curve, and selecting the compliance curves based on predictions by a shock model of shock generated by the perforating string.

8 Claims, 14 Drawing Sheets

U.S. PATENT DOCUMENTS 3,054,450 A 9/1962 Baker, Jr. et al.
3,128,825 A 4/1964 Blagg
3,143,321 A 8/1964 Mcgehee et al.
3,208,378 A 9/1965 Boop
3,216,751 A 11/1965 Der Mott
3,394,612 A 7/1968 Bogosoff et al.
3,414,071 A 12/1968 Alberts
3,653,468 A 4/1972 Marshall
3,779,591 A 12/1973 Rands
3,923,105 A 12/1975 Lands, Jr.
3,923,106 A 12/1975 Bosse-Platiere
3,923,107 A 12/1975 Dillard
3,971,926 A 7/1976 Gau et al.
4,269,063 A 5/1981 Escaron et al.
4,346,795 A 8/1982 Herbert
4,409,824 A 10/1983 Salama et al.
4,410,051 A 10/1983 Daniel et al.
4,419,933 A 12/1983 Kirby et al.
4,480,690 A 11/1984 Vann
4,575,026 A 3/1986 Brittain et al.
4,598,776 A 7/1986 Stout
4,612,992 A 9/1986 Vann et al.
4,619,333 A 10/1986 George
4,637,478 A 1/1987 George
4,679,669 A 7/1987 Kalb et al.
4,693,317 A 9/1987 Edwards et al.
4,694,878 A 9/1987 Gambertoglio
4,764,231 A 8/1988 Slawinski et al.
4,817,710 A 4/1989 Edwards et al.
4,830,120 A 5/1989 Stout
4,842,059 A 6/1989 Tomek
4,913,053 A 4/1990 McPhee
4,971,153 A 11/1990 Rowe et al.
5,044,437 A 9/1991 Wittrisch
5,078,210 A 1/1992 George
5,088,557 A 2/1992 Ricles et al.
5,092,167 A 3/1992 Finley et al.
5,103,912 A 4/1992 Flint
5,107,927 A 4/1992 Whiteley et al.
5,109,355 A 4/1992 Yuno
5,117,911 A 6/1992 Navarette et al.
5,131,470 A 7/1992 Miszewski et al.
5,133,419 A 7/1992 Barrington
5,161,616 A 11/1992 Colla
5,188,191 A 2/1993 Tomek
5,216,197 A 6/1993 Huber et al.
5,343,963 A 9/1994 Bouldin et al.
5,351,791 A 10/1994 Rosenzweig
5,366,013 A 11/1994 Edwards et al.
5,421,780 A 6/1995 Vukovic
5,529,127 A 6/1996 Burleson et al.
5,547,148 A 8/1996 Del Monte et al.
5,603,379 A 2/1997 Henke et al.
5,662,166 A 9/1997 Shammai
5,774,420 A 6/1998 Heysse et al.
5,813,480 A 9/1998 Zaleski, Jr. et al.
5,823,266 A 10/1998 Burleson et al.
5,826,654 A 10/1998 Adnan et al.
5,957,209 A 9/1999 Burleson et al.
5,964,294 A 10/1999 Edwards et al.
5,992,523 A 11/1999 Burleson et al.
6,012,015 A 1/2000 Tubel
6,021,377 A 2/2000 Dubinsky et al.
6,068,394 A 5/2000 Dublin, Jr.
6,078,867 A 6/2000 Plumb et al.
6,098,716 A 8/2000 Hromas et al.
6,109,335 A 8/2000 Jolivet et al.
6,135,252 A 10/2000 Knotts
6,216,533 B1 4/2001 Woloson et al.
6,230,101 B1 5/2001 Wallis
6,283,214 B1 9/2001 Guinot et al.
6,308,809 B1 10/2001 Reid et al.
6,371,541 B1 4/2002 Pedersen
6,394,241 B1 5/2002 Desjardins et al.
6,408,953 B1 6/2002 Goldman et al.
6,412,415 B1 7/2002 Kothari et al.
6,412,614 B1 7/2002 Lagrange et al.
6,450,022 B1 9/2002 Brewer
6,454,012 B1 9/2002 Reid
6,457,570 B2 10/2002 Reid et al.
6,484,801 B2 11/2002 Brewer et al.
6,550,322 B2 4/2003 Sweetland et al.
6,595,290 B2 7/2003 George et al.
6,672,405 B2 * 1/2004 Tolman et al. ..... 175/4.52
6,674,432 B2 1/2004 Kennon et al.
6,679,323 B2 1/2004 Vargervik et al.
6,679,327 B2 1/2004 Sloan et al.
6,684,949 B1 2/2004 Gabler et al.
6,708,761 B2 3/2004 George et al.
6,810,370 B1 10/2004 Watts, III
6,826,483 B1 11/2004 Anderson
6,832,159 B2 12/2004 Smits et al.
6,842,725 B1 1/2005 Sarda
6,868,920 B2 3/2005 Hoteit et al.
7,000,699 B2 2/2006 Yang et al.
7,006,959 B1 2/2006 Huh et al.
7,044,219 B2 5/2006 Mason et al.
7,114,564 B2 10/2006 Parrott et al.
7,121,340 B2 10/2006 Grove et al.
7,139,689 B2 11/2006 Huang
7,147,088 B2 12/2006 Reid et al.
7,165,612 B2 1/2007 McLaughlin
7,178,608 B2 2/2007 Mayes et al.
7,195,066 B2 3/2007 Sukup et al.
7,234,517 B2 6/2007 Streich et al.
7,246,659 B2 7/2007 Fripp et al.
7,260,508 B2 8/2007 Lim et al.
7,278,480 B2 10/2007 Longfield et al.
7,387,160 B2 6/2008 O'Shaughnessy et al.
7,387,162 B2 6/2008 Mooney, Jr. et al.
7,503,403 B2 3/2009 Jogi et al.
7,509,245 B2 3/2009 Siebrits et al.
7,533,722 B2 5/2009 George et al.
7,600,568 B2 10/2009 Ross et al.
7,603,264 B2 10/2009 Zamora et al.
7,640,986 B2 1/2010 Behrmann et al.
7,721,650 B2 5/2010 Barton et al.
7,721,820 B2 5/2010 Hill et al.
7,770,662 B2 8/2010 Harvey et al.
8,126,646 B2 2/2012 Grove et al.
8,136,608 B2 3/2012 Goodman
2002/0121134 A1 9/2002 Sweetland et al.
2003/0062169 A1 4/2003 Marshall
2003/0089497 A1 * 5/2003 George et al. ..... 166/297
2003/0150646 A1 8/2003 Brooks et al.
2004/0045351 A1 3/2004 Skinner
2004/0104029 A1 6/2004 Martin
2004/0140090 A1 * 7/2004 Mason et al. ..... 166/242.1
2006/0070734 A1 4/2006 Zillinger et al.
2006/0118297 A1 6/2006 Finci et al.
2006/0243453 A1 11/2006 McKee
2007/0101808 A1 5/2007 Irani et al.
2007/0193740 A1 8/2007 Quint
2007/0214990 A1 9/2007 Barkley et al.
2008/0041597 A1 2/2008 Fisher et al.
2008/0149338 A1 6/2008 Goodman et al.
2008/0216554 A1 9/2008 McKee
2008/0245255 A1 10/2008 Barton et al.
2008/0262810 A1 10/2008 Moran et al.
2008/0314582 A1 12/2008 Belani et al.
2009/0013775 A1 1/2009 Bogath et al.
2009/0071645 A1 3/2009 Kenison et al.
2009/0084535 A1 4/2009 Bertoja et al.
2009/0151589 A1 6/2009 Henderson et al.
2009/0159284 A1 * 6/2009 Goodman ..... 166/297
2009/0241658 A1 10/2009 Irani et al.
2010/0000789 A1 1/2010 Barton et al.
2010/0037793 A1 2/2010 Lee et al.
2010/0132939 A1 * 6/2010 Rodgers ..... 166/244.1
2010/0133004 A1 6/2010 Burleson et al.
2010/0147519 A1 * 6/2010 Goodman ..... 166/297
2012/0085539 A1 4/2012 Tonnessen et al.
2012/0152519 A1 6/2012 Rodgers et al.
2012/0152542 A1 6/2012 Le
2012/0152614 A1 6/2012 Rodgers et al.
2012/0152615 A1 6/2012 Rodgers et al.
2012/0152616 A1 6/2012 Rodgers et al.

2012/0158388 A1 6/2012 Rodgers et al.
2012/0181026 A1 7/2012 Le et al.
2012/0247769 A1 10/2012 Schacherer et al.

OTHER PUBLICATIONS

International Search Report with Written Opinion issued Sep. 2, 2011 for PCT Patent Application No. PCT/US11/050395, 9 pages.
International Search Report with Written Opinion issued Aug. 31, 2011 for PCT Patent Application No. PCT/US11/049882, 9 pages.
Office Action issued Feb. 24, 2012 for U.S. Appl. No. 13/304,075, 15 pages.
Office Action issued Apr. 10, 2012 for U.S. Appl. No. 13/325,726, 26 pages.
Office Action issued Jul. 12, 2012 for U.S. Appl. No. 13/413,588, 42 pages.
Office Action issued Jul. 26, 2012 for U.S. Appl. No. 13/325,726, 52 pages.
Office Action issued Aug. 2, 2012 for U.S. Appl. No. 13/210,303, 35 pages.
Australian Office Action issued Sep. 21, 2012 for AU Patent Application No. 2010365400, 3 pages.
IES, Scott A. Ager; "IES Housing and High Shock Considerations", informational presentation, received Sep. 1, 2010, 18 pages.
IES, Scott A. Ager; Analog Recorder Test Example, informational letter, dated Sep. 1, 2010, 1 page.
IES, Scott A. Ager; "Series 300 Gauge", product information, dated Sep. 1, 2010, 1 page.
IES, Scott A. Ager; "IES Introduction", Company introduction presentation, received Sep. 1, 2010, 23 pages.
Petroleum Experts; "IPM: Engineering Software Development", product brochure, dated 2008, 27 pages.
International Search Report with Written Opinion issued Oct. 27, 2011 for PCT Patent Application No. PCT/ US11/034690, 9 pages.
Kappa Engineering; "Petroleum Exploration and Product Software, Training and Consulting", product informational paper on v4.12B, dated Jan. 2010, 48 pages.
Qiankun Jin, Zheng Shigui, Gary Ding, Yianjun, Cui Binggui, Beijing Engeneering Software Technology Co. Ltd.; "3D Numerical Simulations of Penetration of Oil-Well Perforator into Concrete Targets", Paper for the 7th International LS-DYNA Users Conference, received Jan. 28, 2010, 6 pages.
Mario Dobrilovic, Zvonimir Ester, Trpimir Kujundzic; "Measurements of Shock Wave Force in Shock Tube with Indirect Methods", Original scientific paper vol. 17, str. 55-60, dated 2005, 6 pages.
IES, Scott A. Ager; "Model 64 and 74 Buildup", product presentation, dated Oct. 17, 2006,57 pages.
A. Blakeborough et al.; "Novel Load Cell for Measuring Axial Forca, Shear Force, and Bending Movement in large-scale Structural Experiments", Informational paper, dated Mar. 23-Aug. 30, 2001, 8 pages.
Weibing Li et al.; "The Effect of Annular Multi-Point Initiation on the Formation and Penetration of an Explosively Formed Penetrator", Article in the International Journal of Impact Engineering, dated Aug. 27, 2009, 11 pages.
Sergio Murilo et al.; "Optimization and Automation of Modeling of Flow Perforated Oil Wells", Presentation for the Product Development Conference, dated 2004, 31 pages.
Frederic Bruyere et al.; "New Practices to Enhance Perforating Results", Oilfield Review, dated Autumn 2006, 18 pages.
John F. Schatz; "Pert Breakdown, Fracturing, and Cleanup in PulsFrac", informational brochure, dated May 2, 2007, 6 pages.
M. A. Proett et al.; "Productivity Optimization of Oil Wells Using a New 3D Finite-Element Wellbore Inflow Model and Artificial Neutral Network", conference paper, dated 2004, 17 pages.
John F. Schatz; "PulsFrac Summary Technical Description", informational brochure, dated 2003, 8 pages.
IES, Scott A. Ager; "IES Recorder Buildup", Company presentation, received Sep. 1, 2010, 59 pages.
IES, Scott A. Ager; "IES Sensor Discussion", received Sep. 1, 2010, 38 pages.
IES; "Series 300: High Shock, High Speed Pressure Gauge", product brochure, dated Feb. 1, 2012, 2 pages.
Specification and drawing for U.S. Appl. No. 13/413,588, filed Mar. 6, 2012, 30 pages.
Scott A. Ager; "IES Fast Speed Gauges", informational presentation, dated Mar. 2, 2009, 38 pages.
IES; "Battery Packing for High Shock", article AN102, received Sep. 1, 2010, 4 pages.
IES; "Accelerometer Wire Termination", article AN106, received Sep. 1, 2010, 4 pages.
John F. Schatz; "PulsFrac Validation: Owen/HTH Surface Block Test", product information, dated 2004, 4 pages.
Offshore Technology Conference; "Predicting Pressure Behavior and Dynamic Shock Loads on Completion Hardware During Perforating", OTC 21059, dated May 3-6, 2010, 11 pages.
IES; "Series 200: High Shock, High Speed Pressure and Acceleration Gauge", product brochure, received Feb. 11, 2010, 2 pages.
Terje Rudshaug, et al.; "A toolbox for improved Reservoir Management", NETool, FORCE AWTC Seminar, Apr. 21-22, 2004, 29 pages.
Halliburton; "ShockPro Schockload Evaluation Service", Perforating Solutions pp. 5-125 to 5-126, dated 2007, 2 pages.
Halliburton; "ShockPro Schockload Evaluation Service", H03888, dated Jul. 2007, 2 pages.
Strain Gages; "Positioning Strain Gages to Monitor Bending, Axial, Shear, and Torsional Loads", pp. E-5 to E-6, dated 2012, 2 pages.
B. Grove, et al.; "Explosion-Induced Damage to Oilwell Perforating Gun Carriers", Structures Under Shock and Impact IX, vol. 87, ISSN 1743-3509, SU060171, dated 2006, 12 pages.
WEM; "Well Evaluation Model", product brochure, received Mar. 2, 2010, 2 pages.
Endevco; "Problems in High-Shock Measurement", MEGGITT brochure TP308, dated Jul. 2007, 9 pages.
John F. Schatz; "Casing Differential in PulsFrac Calculations", product information, dated 2004, 2 pages.
John F. Schatz; "The Role of Compressibility in PulsFrac Software", informational paper, dated Aug. 22, 2007, 2 pages.
"2010 International Perforating Symposium", Agenda, dated May 6-7, 2010, 2 pages.
ESSCA Group; "Erin Dynamic Flow Analysis Platform", online article, dated 2009, 1 page.
Halliburton; "Fast Gauge Recorder", article 5-110, received Nov. 16, 2010, 2 pages.
Kenji Furui; "A Comprehensive Skin Factor Model for Well Completions Based on Finite Element Simulations", informational paper, dated May 2004, 182 pages.
Halliburton; "Simulation Software for EquiFlow ICD Completions", H07010, dated Sep. 2009, 2 pages.
Specification and drawing for U.S. Appl. No. 13/377,148, filed Dec. 8, 2011, 47 pages.
Halliburton; "AutoLatch Release Gun Connector", Special Applications 6-7, received Jan. 19, 2011, 1 page.
Halliburton; "Body Lock Ring", Mechanical Downhole: Technology Transfer, dated Oct. 10, 2001, 4 pages.
Office Action issued Jun. 13, 2012 for U.S. Appl. No. 13/377,148, 38 pages.
Carlos Baumann, Harvey Williams, and Schlumberger; "Perforating Wellbore Dynamics and Gunshock in Deepwater TCP Operations", Product informational presentation, IPS-10-018, received May 11, 2011, 28 pages.
Schlumberger; "SXVA Explosively Initiated Vertical Shock Absorber", product paper 06-WT-066, dated 2007, 1 page.
International Search Report with Written Opinion issued Dec. 27, 2011 for PCT Patent Application No. PCT/US11/046955, 8 pages.
International Search Report with Written Opinion issued Jul. 28, 2011 for International Application No. PCT/US10/61104, 8 pages.
International Search Report with Written Opinion issued Oct. 27, 2011 for International Application No. PCT/US11/034690, 9 pages.
International Search Report with Written Opinion issued Jul. 28, 2011 for International Application No. PCT/US10/061107, 9 pages.
Office Action issued May 4, 2011 for U.S. Appl. No. 11/957,541, 9 pages.
International Search Report with Written Opinion issued Nov. 30, 2011 for PCT/US11/036686, 10 pages.

Office Action issued Sep. 6, 2012 for U.S. Appl. No. 13/495,035, 28 pages.
Specification and drawing for U.S. Appl. No. 13/585,846, filed Aug. 25, 2012, 45 pages.
Office Action issued Sep. 8, 2009, for U.S. Appl. No. 11/957,541, 10 pages.
Office Action issued Feb. 2, 2010, for U.S. Appl. No. 11/957,541, 8 pages.
Office Action issued Jul. 15, 2010, for U.S. Appl. No. 11/957,541, 6 pages.
Office Action issued Nov. 22, 2010, for U.S. Appl. No. 11/957,541, 6 pages.
Australian Examination Report issued 21 Sep. 2012 for AU Patent Application No. 2010365400, 3 pages.
Office Action issued Apr. 21, 2011, for U.S. Appl. No. 13/008,075, 9 pages.
J.A. Regalbuto et al; "Computer Codes for Oilwell-Perforator Design", SPE 30182, dated Sep. 1997, 8 pages.
J.F. Schatz et al; "High-Speed Downhole Memory Recorder and Software Used to Design and Confirm Perforating/Propellant Behavior and Formation Fracturing", SPE 56434, dated Oct. 3-6, 1999, 9 pages.
Joseph Ansah et al; "Advances in Well Completion Design: A New 3D Finite-Element Wellbore Inflow Model for Optimizing Performance of Perforated Completions", SPE 73760, Feb. 20-21, 2002, 11 pages.
D. A. Cuthill et al; "A New Technique for Rapid Estimation of Fracture Closure Stress When Using Propellants", SPE 78171, dated Oct. 20-23, 2002, 6 pages.
J.F. Schatz et al; "High-Speed Pressure and Accelerometer Measurements Characterize Dynamic Behavior During Perforating Events in Deepwater Gulf of Mexico", SPE 90042, dated Sep. 26-29, 2004, 15 pages.
Liang-Biao Ouyang et al; "Case Studies for Improving Completion Design Through Comprehensive Well-Performance Modeling", SPE 104078, dated Dec. 5-7, 2006, 11 pages.
Liang-Biao Ouyang et al; "Uncertainty Assessment on Well-Performance Prediction for an Oil Producer Equipped With Selected Completions", SPE 106966, dated Mar. 31-Apr. 3, 2007, 9 pages.
B. Grove et al; "new Effective Stress Law for Predicting Perforation Depth at Downhole Conditions", SPE 111778, dated Feb. 13-15, 2008, 10 pages.
Office Action issued Oct. 1, 2012 for U.S. Appl. No. 13/325,726, 20 pages.
Office Action issued Oct. 23, 2012 for U.S. Appl. No. 13/325,866, 35 pages.
Office Action issued Mar. 31, 2013 for U.S. Appl. No. 13/413,588, 14 pages.
Office Action issued Mar. 31, 2013 for U.S. Appl. No. 13/430,550, 17 pages.

* cited by examiner

COUPLER COMPLIANCE TUNING FOR MITIGATING SHOCK PRODUCED BY WELL PERFORATING

CROSS-REFERENCE TO RELATED APPLICATIONS

This application is a continuation of U.S. application Ser. No. 13/325,726 filed on 14 Dec. 2011, which claims the benefit under 35 USC §119 of the filing date of International Application Serial No. PCT/US11/46955 filed 8 Aug. 2011, International Patent Application Serial No. PCT/US11/34690 filed 29 Apr. 2011, and International Patent Application Serial No. PCT/US10/61104 filed 17 Dec. 2010. The entire disclosures of these prior applications are incorporated herein by this reference.

BACKGROUND

The present disclosure relates generally to equipment utilized and operations performed in conjunction with a subterranean well and, in an embodiment described herein, more particularly provides for mitigating shock produced by well perforating.

Attempts have been made to model the effects of shock due to perforating. It would be desirable to be able to predict shock due to perforating, for example, to prevent unsetting a production packer, to prevent failure of a perforating gun body, and to otherwise prevent or at least reduce damage to various components of a perforating string. In some circumstances, shock transmitted to a packer above a perforating string can even damage equipment above the packer.

In addition, wells are being drilled deeper, perforating string lengths are getting longer, and explosive loading is getting greater, all in efforts to achieve enhanced production from wells. These factors are pushing the envelope on what conventional perforating strings can withstand.

Unfortunately, past shock models have not been able to predict shock effects in axial, bending and torsional directions, and to apply these shock effects to three dimensional structures, thereby predicting stresses in particular components of the perforating string. One hindrance to the development of such a shock model has been the lack of satisfactory measurements of the strains, loads, stresses, pressures, and/or accelerations, etc., produced by perforating. Such measurements can be useful in verifying a shock model and refining its output.

Therefore, it will be appreciated that improvements are needed in the art. These improvements can be used, for example, in designing new perforating string components which are properly configured for the conditions they will experience in actual perforating situations, and in preventing damage to any equipment.

SUMMARY

In carrying out the principles of the present disclosure, a method is provided which brings improvements to the art. One example is described below in which the method is used to adjust predictions made by a shock model, in order to make the predictions more precise. Another example is described below in which the shock model is used to optimize a design of a perforating string.

A method of mitigating shock produced by well perforating is provided to the art by the disclosure below. In one example, the method includes causing a shock model to predict perforating effects for a proposed perforating string, optimizing a compliance curve of at least one proposed coupler, thereby mitigating the perforating effects for the proposed perforating string, and providing at least one actual coupler having substantially the same compliance curve as the proposed coupler.

Also described below is a well system. In one example, the well system can comprise a perforating string including at least one perforating gun and multiple couplers, each of the couplers having a compliance curve. At least two of the compliance curves are different from each other.

A method of mitigating perforating effects produced by well perforating is also provided to the art. In one example, the method can include interconnecting multiple couplers spaced apart in a perforating string, each of the couplers having a compliance curve, and selecting the compliance curves based on predictions by a shock model of perforating effects generated by the perforating string.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
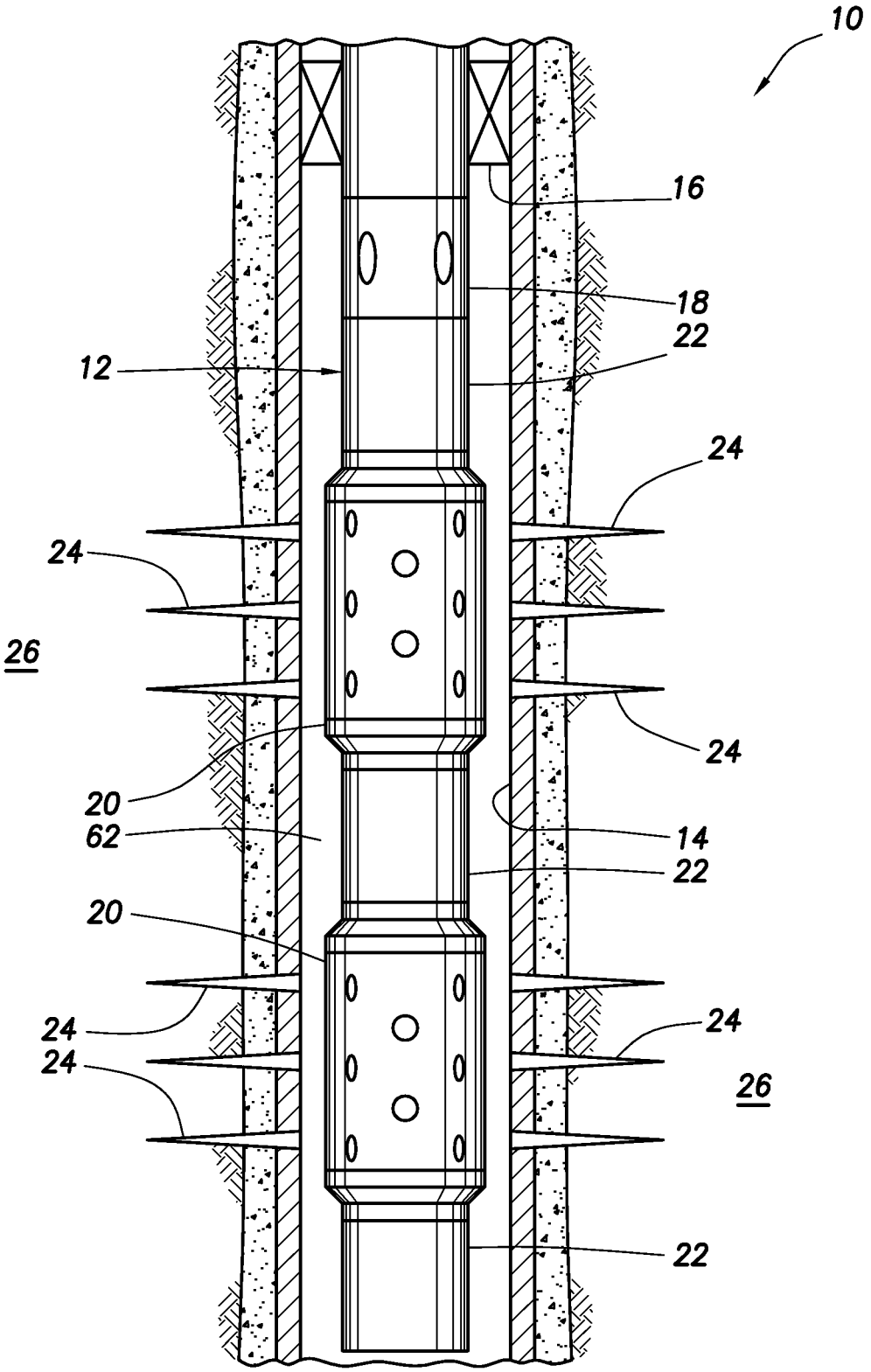
FIG. 1 is a schematic partial cross-sectional view of a well system and associated method which can embody principles of the present disclosure.

Representatively illustrated in FIG. 1 is a well system 10 and associated method which can embody principles of this disclosure. In the well system 10, a perforating string 12 is installed in a wellbore 14. The depicted perforating string 12 includes a packer 16, a firing head 18, perforating guns 20 and shock sensing tools 22.

In other examples, the perforating string 12 may include more or less of these components. For example, well screens and/or gravel packing equipment may be provided, any number (including one) of the perforating guns 20 and shock sensing tools 22 may be provided, etc. Thus, it should be clearly understood that the well system 10 as depicted in FIG. 1 is merely one example of a wide variety of possible well systems which can embody the principles of this disclosure.

A shock model can use a three dimensional geometrical representation of the perforating string 12 and wellbore 14 to realistically predict the physical behavior of the system 10 during a perforating event. Preferably, the shock model will predict at least bending, torsional and axial loading, as well as motion in all directions (three dimensional motion). The model can include predictions of casing contact and friction, and the loads that result from it.

In a preferred example, detailed three dimensional finite element models of the components of the perforating string 12 enable a higher fidelity prediction of stresses in the components. Component materials and characteristics (such as compliance, stiffness, friction, etc.), wellbore pressure dynamics and communication with a formation can also be incorporated into the model.

The shock model is preferably calibrated using actual perforating string loads and accelerations, as well as wellbore pressures, collected from one or more of the shock sensing tools 22. Measurements taken by the shock sensing tools 22 can be used to verify the predictions made by the shock model, and to make adjustments to the shock model, so that future predictions are more accurate.

The shock sensing tool 22 can be as described in International Application No. PCT/US10/61102, filed on 17 Dec. 2010, the entire disclosure of which is incorporated herein by this reference. That patent application discloses that the shock sensing tools 22 can be interconnected in various locations along the perforating string 12.

One advantage of interconnecting the shock sensing tools 22 below the packer 16 and in close proximity to the perforating guns 20 is that more accurate measurements of strain and acceleration at the perforating guns can be obtained. Pressure and temperature sensors of the shock sensing tools 22 can also sense conditions in the wellbore 14 in close proximity to perforations 24 immediately after the perforations are formed, thereby facilitating more accurate analysis of characteristics of an earth formation 26 penetrated by the perforations.

A shock sensing tool 22 interconnected between the packer 16 and the upper perforating gun 20 can record the effects of perforating on the perforating string 12 above the perforating guns. This information can be useful in preventing unsetting or other damage to the packer 16, firing head 18 (although damage to a firing head is usually not a concern), etc., due to detonation of the perforating guns 20 in future designs.

A shock sensing tool 22 interconnected between perforating guns 20 can record the effects of perforating on the perforating guns themselves. This information can be useful in preventing damage to components of the perforating guns 20 in future designs.

A shock sensing tool 22 can be connected below the lower perforating gun 20, if desired, to record the effects of perforating at this location. In other examples, the perforating string 12 could be stabbed into a lower completion string, connected to a bridge plug or packer at the lower end of the perforating string, etc., in which case the information recorded by the lower shock sensing tool 22 could be useful in preventing damage to these components in future designs.

Viewed as a complete system, the placement of the shock sensing tools 22 longitudinally spaced apart along the perforating string 12 allows acquisition of data at various points in the system, which can be useful in validating a model of the system. Thus, collecting data above, between and below the guns, for example, can help in an understanding of the overall perforating event and its effects on the system as a whole.

The information obtained by the shock sensing tools 22 is not only useful for future designs, but can also be useful for current designs, for example, in post-job analysis, formation testing, etc. The applications for the information obtained by the shock sensing tools 22 are not limited at all to the specific examples described herein.

Figure 2:
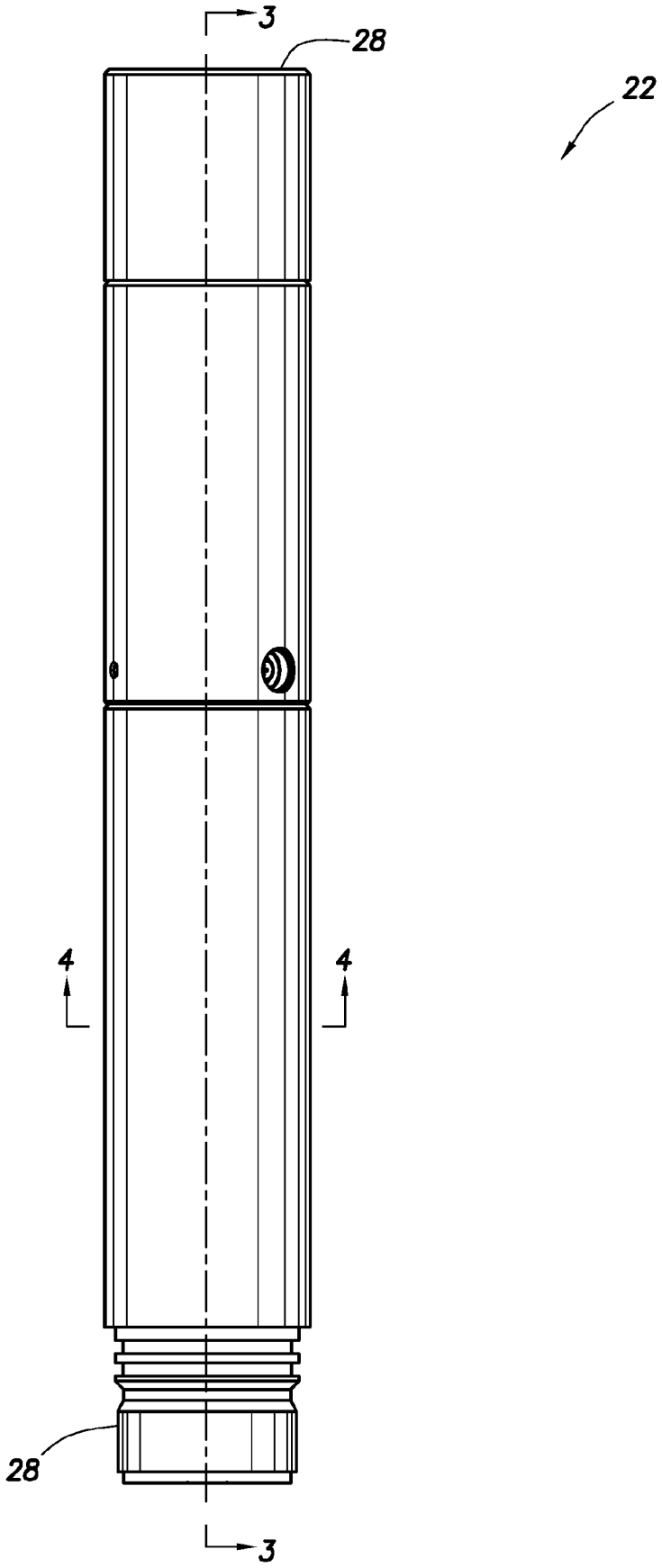
FIGS. 2-5 are schematic views of a shock sensing tool which may be used in the system and method of FIG. 1.

Referring additionally now to FIGS. 2-5, one example of the shock sensing tool 22 is representatively illustrated. As depicted in FIG. 2, the shock sensing tool 22 is provided with end connectors 28 (such as, perforating gun connectors, etc.) for interconnecting the tool in the perforating string 12 in the well system 10. However, other types of connectors may be used, and the tool 22 may be used in other perforating strings and in other well systems, in keeping with the principles of this disclosure.

Figure 3:
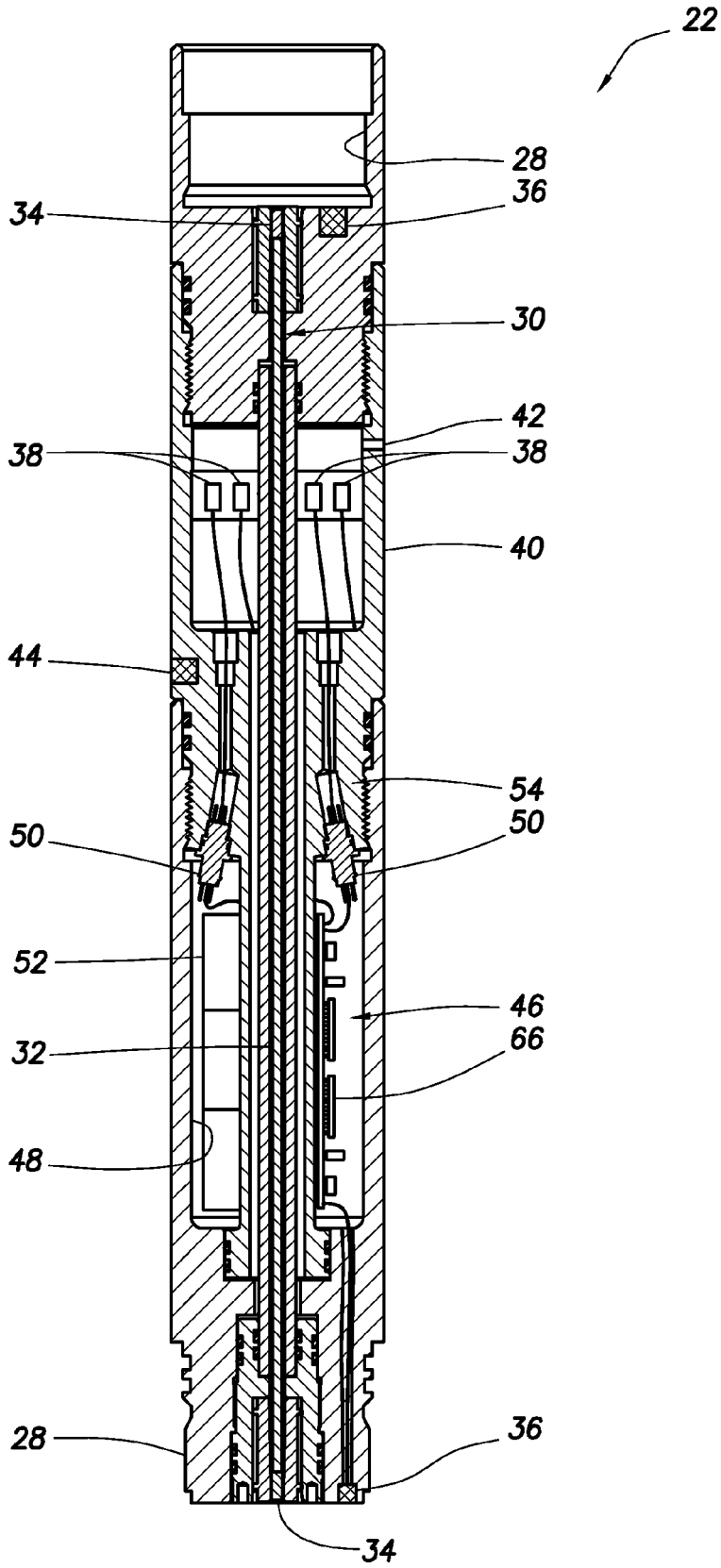

In FIG. 3, a cross-sectional view of the shock sensing tool 22 is representatively illustrated. In this view, it may be seen that the tool 22 includes a variety of sensors, and a detonation train 30 which extends through the interior of the tool.

The detonation train 30 can transfer detonation between perforating guns 20, between a firing head (not shown) and a perforating gun, and/or between any other explosive components in the perforating string 12. In the example of FIGS. 2-5, the detonation train 30 includes a detonating cord 32 and explosive boosters 34, but other components may be used, if desired.

One or more pressure sensors 36 may be used to sense pressure in perforating guns, firing heads, etc., attached to the connectors 28. Such pressure sensors 36 are preferably ruggedized (e.g., to withstand ~20000 g acceleration) and capable of high bandwidth (e.g., >20 kHz). The pressure sensors 36 are preferably capable of sensing up to ~60 ksi (~414 MPa) and withstanding ~175 degrees C. Of course, pressure sensors having other specifications may be used, if desired.

Strain sensors 38 are attached to an inner surface of a generally tubular structure 40 interconnected between the connectors 28. The structure 40 is pressure balanced, i.e., with substantially no pressure differential being applied across the structure.

In particular, ports 42 are provided to equalize pressure between an interior and an exterior of the structure 40. By equalizing pressure across the structure 40, the strain sensor 38 measurements are not influenced by any differential pressure across the structure before, during or after detonation of the perforating guns 20.

In other examples, the ports 42 may not be provided, and the structure 40 may not be pressure balanced. In that case, a strain sensor may be used to measure strain in the structure 40 due to a pressure imbalance across the structure, and that strain may be compensated for in the calculations of shock loading due to the perforating event.

The strain sensors 38 are preferably resistance wire-type strain gauges, although other types of strain sensors (e.g., piezoelectric, piezoresistive, fiber optic, etc.) may be used, if desired. In this example, the strain sensors 38 are mounted to a strip (such as a KAPTON™ strip) for precise alignment, and then are adhered to the interior of the structure 40.

Preferably, five full Wheatstone bridges are used, with opposing 0 and 90 degree oriented strain sensors being used for sensing hoop, axial and bending strain, and +/−45 degree gauges being used for sensing torsional strain.

The strain sensors 38 can be made of a material (such as a KARMA™ alloy) which provides thermal compensation, and allows for operation up to ~150 degrees C. Of course, any type or number of strain sensors may be used in keeping with the principles of this disclosure.

The strain sensors 38 are preferably used in a manner similar to that of a load cell or load sensor. A goal is to have all of the loads in the perforating string 12 passing through the structure 40 which is instrumented with the sensors 38.

Having the structure 40 fluid pressure balanced enables the loads (e.g., axial, bending and torsional) to be measured by the sensors 38, without influence of a pressure differential across the structure. In addition, the detonating cord 32 is housed in a tube 33 which is not rigidly secured at one or both of its ends, so that it does not share loads with, or impart any loading to, the structure 40.

A temperature sensor 44 (such as a thermistor, thermocouple, etc.) can be used to monitor temperature external to the tool. Temperature measurements can be useful in evaluating characteristics of the formation 26, and any fluid produced from the formation, immediately following detonation of the perforating guns 20. Preferably, the temperature sensor 44 is capable of accurate high resolution measurements of temperatures up to ~170 degrees C.

Another temperature sensor (not shown) may be included with an electronics package 46 positioned in an isolated chamber 48 of the tool 22. In this manner, temperature within the tool 22 can be monitored, e.g., for diagnostic purposes or for thermal compensation of other sensors (for example, to correct for errors in sensor performance related to temperature change). Such a temperature sensor in the chamber 48 would not necessarily need the high resolution, responsiveness or ability to track changes in temperature quickly in wellbore fluid of the other temperature sensor 44.

The electronics package 46 is connected to at least the strain sensors 38 via feed-throughs or bulkhead connectors 50 (which connectors may be pressure isolating, depending on whether the structure 40 is pressure balanced). Similar connectors may also be used for connecting other sensors to the electronics package 46. Batteries 52 and/or another power source may be used to provide electrical power to the electronics package 46.

The electronics package 46 and batteries 52 are preferably ruggedized and shock mounted in a manner enabling them to withstand shock loads with up to ~10000 g acceleration. For example, the electronics package 46 and batteries 52 could be potted after assembly, etc.

Figure 4:
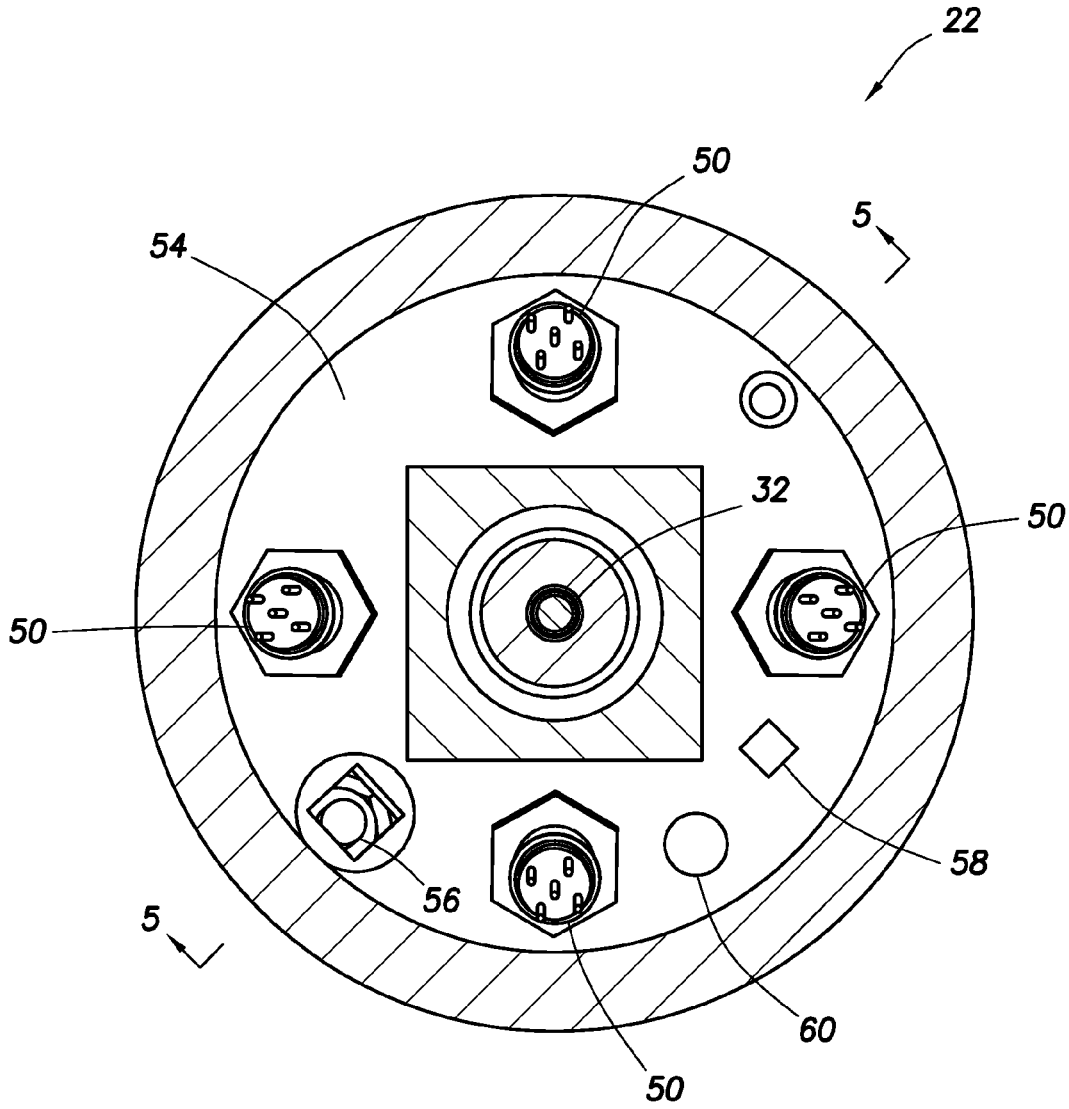

In FIG. 4, it may be seen that four of the connectors 50 are installed in a bulkhead 54 at one end of the structure 40. In addition, a pressure sensor 56, a temperature sensor 58 and an accelerometer 60 are preferably mounted to the bulkhead 54.

The pressure sensor 56 is used to monitor pressure external to the tool 22, for example, in an annulus 62 formed radially between the perforating string 12 and the wellbore 14 (see FIG. 1). The pressure sensor 56 may be similar to the pressure sensors 36 described above. A suitable piezoresistive-type pressure transducer is the Kulite model HKM-15-500.

The temperature sensor 58 may be used for monitoring temperature within the tool 22. This temperature sensor 58 may be used in place of, or in addition to, the temperature sensor described above as being included with the electronics package 46.

The accelerometer 60 is preferably a piezoresistive type accelerometer, although other types of accelerometers may be used, if desired. Suitable accelerometers are available from Endevco and PCB (such as, the PCB 3501A series, which is available in single axis or triaxial packages, capable of sensing up to ~60000 g acceleration).

Figure 5:
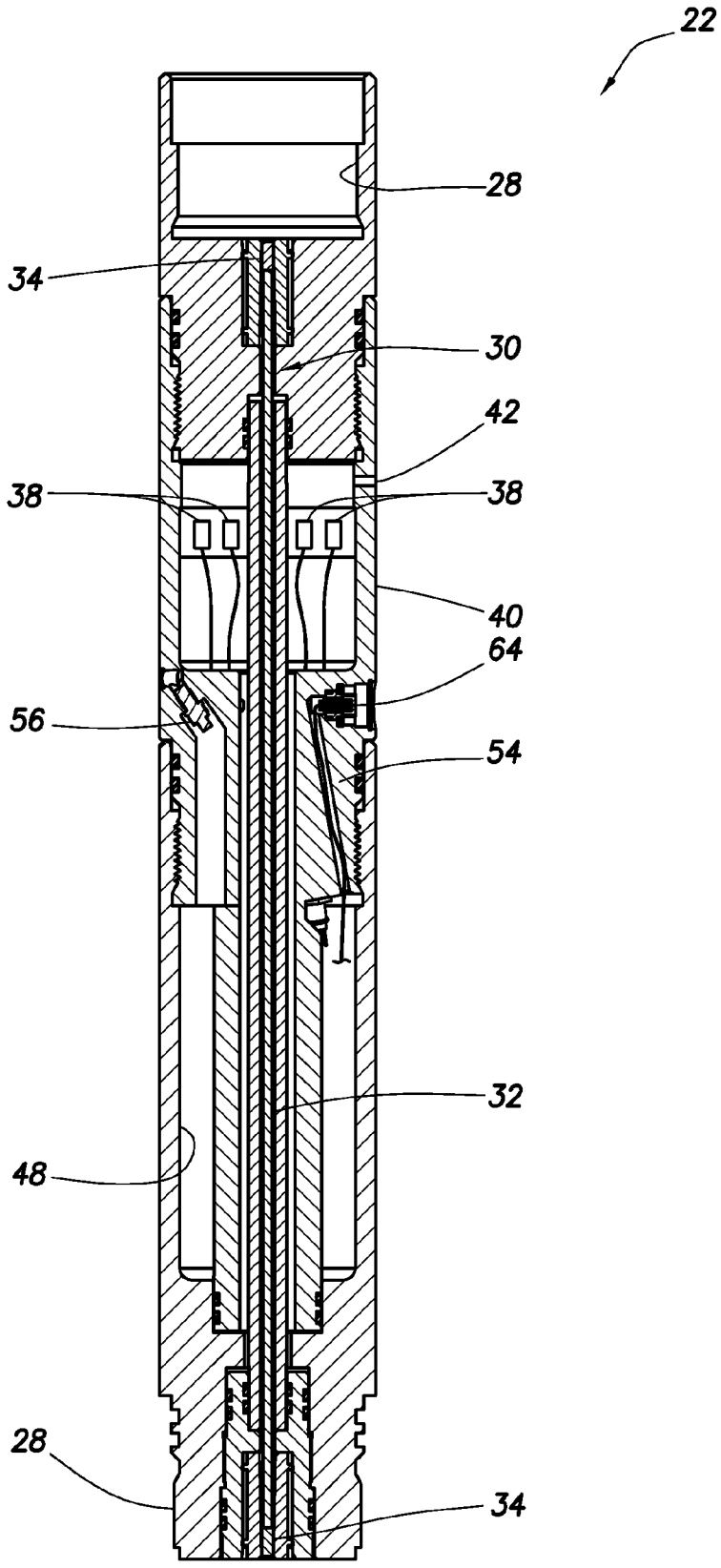

In FIG. 5, another cross-sectional view of the tool 22 is representatively illustrated. In this view, the manner in which the pressure transducer 56 is ported to the exterior of the tool 22 can be clearly seen. Preferably, the pressure transducer 56 is close to an outer surface of the tool, so that distortion of measured pressure resulting from transmission of pressure waves through a long narrow passage is prevented.

Also visible in FIG. 5 is a side port connector 64 which can be used for communication with the electronics package 46 after assembly. For example, a computer can be connected to the connector 64 for powering the electronics package 46, extracting recorded sensor measurements from the electronics package, programming the electronics package to respond to a particular signal or to "wake up" after a selected time, otherwise communicating with or exchanging data with the electronics package, etc.

Note that it can be many hours or even days between assembly of the tool 22 and detonation of the perforating guns 20. In order to preserve battery power, the electronics package 46 is preferably programmed to "sleep" (i.e., maintain a low power usage state), until a particular signal is received, or until a particular time period has elapsed.

The signal which "wakes" the electronics package 46 could be any type of pressure, temperature, acoustic, electromagnetic or other signal which can be detected by one or more of the sensors 36, 38, 44, 56, 58, 60. For example, the pressure sensor 56 could detect when a certain pressure level has been achieved or applied external to the tool 22, or when a particular series of pressure levels has been applied, etc. In response to the signal, the electronics package 46 can be activated to a higher measurement recording frequency, measurements from additional sensors can be recorded, etc.

As another example, the temperature sensor 58 could sense an elevated temperature resulting from installation of the tool 22 in the wellbore 14. In response to this detection of elevated temperature, the electronics package 46 could "wake" to record measurements from more sensors and/or higher frequency sensor measurements.

As yet another example, the strain sensors 38 could detect a predetermined pattern of manipulations of the perforating string 12 (such as particular manipulations used to set the packer 16). In response to this detection of pipe manipulations, the electronics package 46 could "wake" to record measurements from more sensors and/or higher frequency sensor measurements.

The electronics package 46 depicted in FIG. 3 preferably includes a non-volatile memory 66 so that, even if electrical power is no longer available (e.g., the batteries 52 are discharged), the previously recorded sensor measurements can still be downloaded when the tool 22 is later retrieved from the well. The non-volatile memory 66 may be any type of memory which retains stored information when powered off. This memory 66 could be electrically erasable programmable read only memory, flash memory, or any other type of non-volatile memory. The electronics package 46 is preferably able to collect and store data in the memory 66 at greater than 100 kHz sampling rate.

Figure 6:
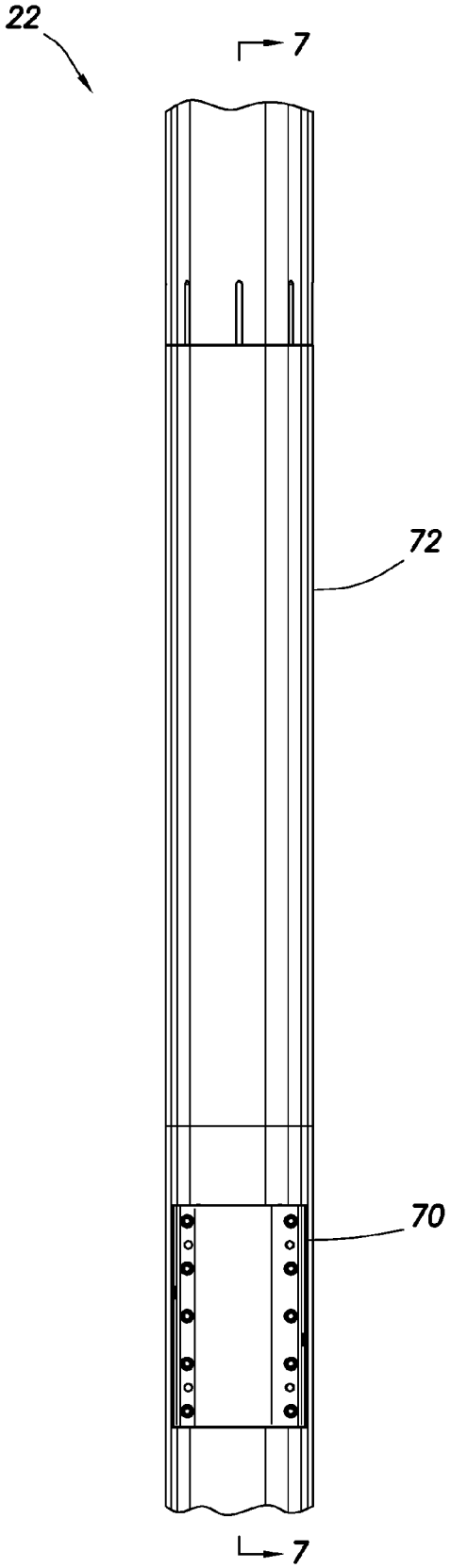
FIGS. 6-8 are schematic views of another configuration of the shock sensing tool.
Figure 7:
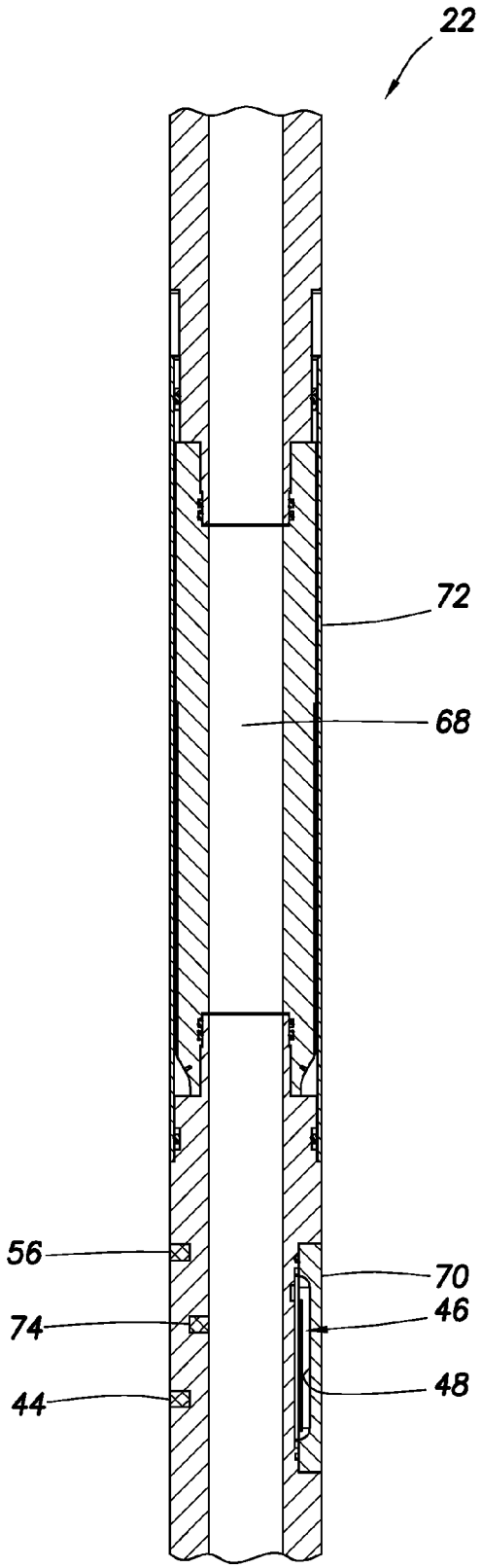
Figure 8:
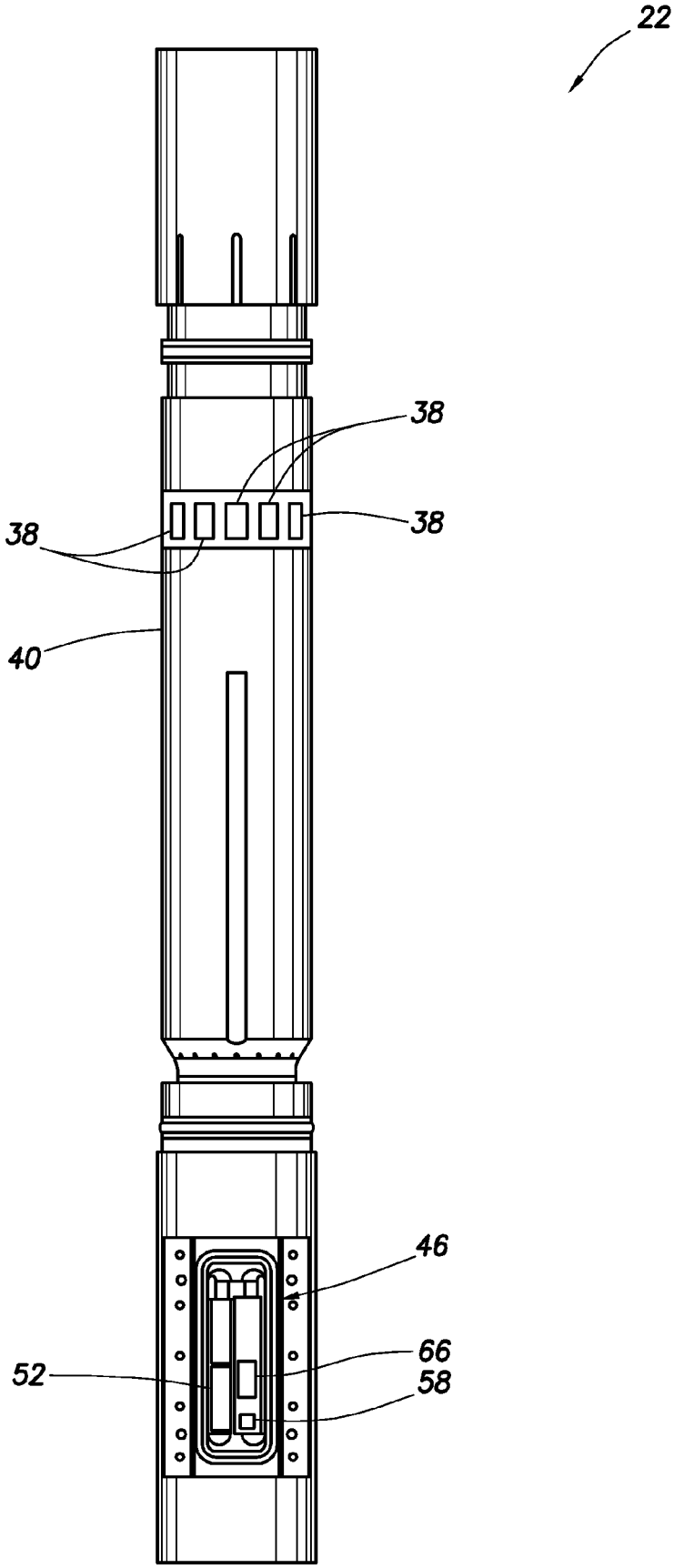

Referring additionally now to FIGS. 6-8, another configuration of the shock sensing tool 22 is representatively illustrated. In this configuration, a flow passage 68 (see FIG. 7) extends longitudinally through the tool 22. Thus, the tool 22 may be especially useful for interconnection between the packer 16 and the upper perforating gun 20, although the tool 22 could be used in other positions and in other well systems in keeping with the principles of this disclosure.

In FIG. 6, it may be seen that a removable cover 70 is used to house the electronics package 46, batteries 52, etc. In FIG. 8, the cover 70 is removed, and it may be seen that the temperature sensor 58 is included with the electronics package 46 in this example. The accelerometer 60 could also be part of the electronics package 46, or could otherwise be located in the chamber 48 under the cover 70.

A relatively thin protective sleeve 72 is used to prevent damage to the strain sensors 38, which are attached to an exterior of the structure 40 (see FIG. 8, in which the sleeve is removed, so that the strain sensors are visible). Although in this example the structure 40 is not pressure balanced, another pressure sensor 74 (see FIG. 7) can be used to monitor pressure in the passage 68, so that any contribution of the pressure differential across the structure 40 to the strain sensed by the strain sensors 38 can be readily determined (e.g., the effective strain due to the pressure differential across the structure 40 is subtracted from the measured strain, to yield the strain due to structural loading alone).

Note that there is preferably no pressure differential across the sleeve 72, and a suitable substance (such as silicone oil, etc.) is preferably used to fill the annular space between the sleeve and the structure 40. The sleeve 72 is not rigidly secured at one or both of its ends, so that it does not share loads with, or impart loads to, the structure 40.

Any of the sensors described above for use with the tool 22 configuration of FIGS. 2-5 may also be used with the tool configuration of FIGS. 6-8.

The structure 40 (in which loading is measured by the strain sensors 38) may experience dynamic loading due only to structural shock by way of being pressure balanced, as in the configuration of FIGS. 2-5. However, other configurations are possible in which this condition can be satisfied. For example, a pair of pressure isolating sleeves could be used, one external to, and the other internal to, the load bearing structure 40 of the FIGS. 6-8 configuration.

The sleeves could encapsulate air at atmospheric pressure on both sides of the structure 40, effectively isolating the structure from the loading effects of differential pressure. The sleeves should be strong enough to withstand the pressure in the well, and may be sealed with o-rings or other seals on both ends. The sleeves may be structurally connected to the tool at no more than one end, so that a secondary load path around the strain sensors 38 is prevented.

Although the perforating string 12 described above is of the type used in tubing-conveyed perforating, it should be clearly understood that the principles of this disclosure are not limited to tubing-conveyed perforating. Other types of perforating (such as, perforating via coiled tubing, wireline or slickline, etc.) may incorporate the principles described herein. Note that the packer 16 is not necessarily a part of the perforating string 12.

With measurements obtained by use of shock sensing tools 22, a shock model can be precisely calibrated, so that it can be applied to proposed perforating system designs, in order to improve those designs (e.g., by preventing failure of, or damage to, any perforating system components, etc.), to optimize the designs in terms of performance, efficiency, effectiveness, etc., and/or to generate optimized designs.

Figure 9:
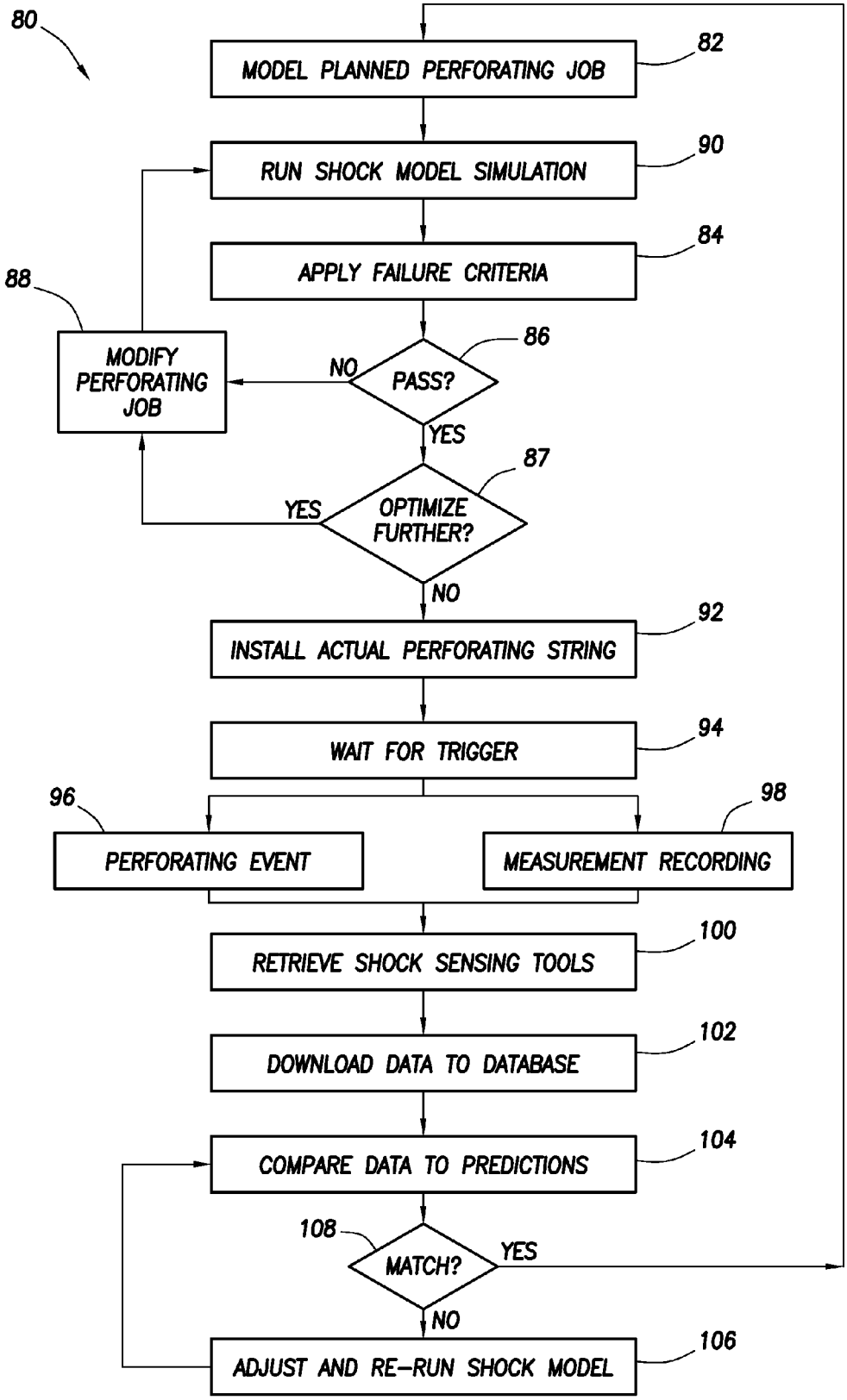
FIG. 9 is a schematic flowchart for the method.

In FIG. 9, a flowchart for the method 80 is representatively illustrated. The method 80 of FIG. 9 can be used with the system 10 described above, or it may be used with a variety of other systems.

In step 82, a planned or proposed perforating job is modeled. Preferably, at least the perforating string 12 and wellbore 14 are modeled geometrically in three dimensions, including material types of each component, expected wellbore communication with the formation 26 upon perforating, etc. Finite element models can be used for the structural elements of the system 10.

Suitable finite element modeling software is LS-DYNA™ available from Livermore Software Technology Corporation. This software can utilize shaped charge models, multiple shaped charge interaction models, flow through permeable rock models, etc. However, other software, modeling techniques and types of models may be used in keeping with the scope of this disclosure.

In steps 90, 84, 86, 87, 88, the perforating string 12 is optimized using the shock model. Various metrics may be used for this optimization process. For example, performance, cost-effectiveness, efficiency, reliability, and/or any other metric may be maximized by use of the shock model. Conversely, undesirable metrics (such as cost, failure, damage, waste, etc.) may be minimized by use of the shock model.

Optimization may also include improving the safety margins for failure as a trade-off with other performance metrics. In one example, it may be desired to have tubing above the perforating guns 20 as short as practical, but failure risks may require that the tubing be longer. So there is a trade-off, and an accurate shock model can help in selecting an appropriate length for the tubing.

Optimization is, in this example, an iterative process of running shock model simulations and modifying the perforating job design as needed to improve upon a valued performance metric. Each iteration of modifying the design influences the response of the system to shock and, thus, the failure criteria is preferably checked every iteration of the optimization process.

In step 90, the shock produced by the perforating string 12 and its effects on the various components of the perforating string are predicted by running a shock model simulation of the perforating job. For example, the perforating system can be input to the shock model to obtain a prediction of stresses, strains, pressures, loading, motion, etc., in the perforating string 12.

Based on the outcome of applying failure criteria to these predictions in step 84 and the desire to optimize the design further, the perforating string 12 can be modified in step 88 as needed to enhance the performance, cost-effectiveness, efficiency, reliability, etc., of the perforating system.

The modified perforating string 12 can then be input into the shock model to obtain another prediction, and another modification of the perforation string can be made based on the prediction. This process can be repeated as many times as needed to obtain an acceptable level of performance, cost-effectiveness, efficiency, reliability, etc., for the perforating system.

Once the perforating string 12 and overall perforating system are optimized, in step 92 an actual perforating string is installed in the wellbore 14. The actual perforating string 12 should be the same as the perforating string model, the actual wellbore 14 should be the same as the modeled wellbore, etc., used in the shock model to produce the prediction in step 90.

In step 94, the shock sensing tool(s) 22 wait for a trigger signal to start recording measurements. As described above, the trigger signal can be any signal which can be detected by the shock sensing tool 22 (e.g., a certain pressure level, a certain pattern of pressure levels, pipe manipulation, a telemetry signal, etc.).

In step 96, the perforating event occurs, with the perforating guns 20 being detonated, thereby forming the perforations 24 and initiating fluid communication between the formation 26 and the wellbore 14. Concurrently with the perforating event, the shock sensing tool(s) 22 in step 98 record various measurements, such as, strains, pressures, temperatures, accelerations, etc. Any measurements or combination of measurements may be taken in this step.

In step 100, the shock sensing tools 22 are retrieved from the wellbore 14. This enables the recorded measurement data to be downloaded to a database in step 102. In other examples, the data could be retrieved by telemetry, by a wireline sonde, etc., without retrieving the shock sensing tools 22 themselves, or the remainder of the perforating string 12, from the wellbore 14.

In step 104, the measurement data is compared to the predictions made by the shock model in step 90. If the predictions made by the shock model do not acceptably match the measurement data, appropriate adjustments can be made to the shock model in step 106 and a new set of predictions generated by running a simulation of the adjusted shock model. If the predictions made by the adjusted shock model still do not acceptably match the measurement data, further adjustments can be made to the shock model, and this process can be repeated until an acceptable match is obtained.

Once an acceptable match is obtained, the shock model can be considered calibrated and ready for use with the next perforating job. Each time the method 80 is performed, the shock model should become more adept at predicting loads, stresses, pressures, motions, etc., for a perforating system, and so should be more useful in optimizing the perforating string to be used in the system.

Over the long term, a database of many sets of measurement data and predictions can be used in a more complex comparison and adjustment process, whereby the shock model adjustments benefit from the accumulated experience represented by the database. Thus, adjustments to the shock model can be made based on multiple sets of measurement data and predictions.

Figure 10:
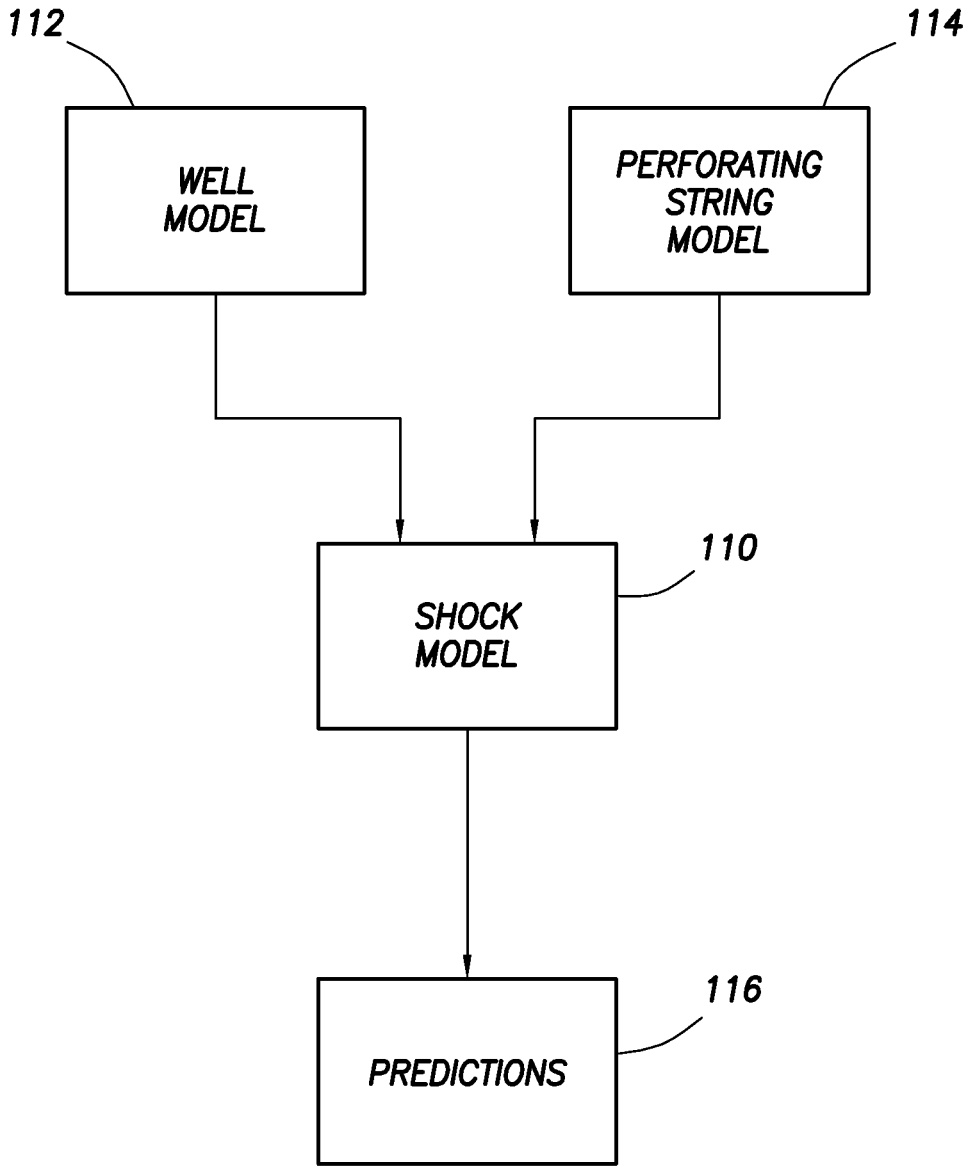
FIG. 10 is a schematic block diagram of a shock model, along with its inputs and outputs.

Referring additionally now to FIG. 10, a block diagram of the shock model 110 and associated well model 112, perforating string model 114 and output predictions 116 are representatively illustrated. As described above, the shock model 110 utilizes the model 112 of the well (including, for example, the geometry of the wellbore 14, the characteristics of the formation 26, the fluid in the wellbore, flow through permeable rock models, etc.) and the model 114 of the perforating string 12 (including, for example, the geometries of the various perforating string components, shaped charge models, shaped charge interaction models, etc.), in order to produce the predictions 116 of loads, stresses, pressures, motions, etc. in the well system 10.

The perforating string 12, wellbore 14 (including, e.g., casing and cement lining the wellbore), fluid in the wellbore, formation 26, and other well components are preferably precisely modeled in three dimensions in high resolution using finite element modeling techniques. For example, the perforating guns 20 can be modeled along with their associated gun body scallops, thread reliefs, etc.

Deviation of the wellbore 14 can be modeled. In this example, deviation of the wellbore 14 is used in predicting contact loads, friction and other interactions between the perforating string 12 and the wellbore 14.

The fluid in the wellbore 14 can be modeled. In this example, the modeled wellbore fluid is a link between the pressures generated by the shaped charges, formation communication, and the perforating string 12 structural model. The wellbore fluid can be modeled in one dimension or, preferably, in three dimensions. Modeling of the wellbore fluid can also be described as a fluid-structure interaction model, a term that refers to the loads applied to the structure by the fluid.

Failures can also occur as a result of high pressures or pressure waves. Thus, it is preferable for the model to predict the fluid behavior, for the reasons that the fluid loads the structure, and the fluid itself can damage the packer or casing directly.

A three dimensional shaped charge model can be used for predicting internal gun pressures and distributions, impact loads of charge cases on interiors of the gun bodies, charge interaction effects, etc.

The shock model 110 can include neural networks, genetic algorithms, and/or any combination of numerical methods to produce the predictions. One particular benefit of the method 80 described above is that the accuracy of the predictions 116 produced by the shock model 110 can be improved by utilizing the actual measurements of the effects of shock taken by the shock sensing tool(s) 22 during a perforating event. The shock model 110 is preferably validated and calibrated using the measurements by the shock sensing tool(s) 22 of actual perforating effects in the perforating string 12.

The shock model 110 and/or shock sensing tool 22 can be useful in failure investigation, that is, to determine why damage or failure occurred on a particular perforating job.

The shock model 110 can be used to optimize the perforating string 12 design, for example, to maximize performance, to minimize stresses, motion, etc., in the perforating string, to provide an acceptable margin of safety against structural damage or failure, etc.

In the application of failure criteria to the predictions generated by the shock model 110, typical metrics, such as material static yield strength, may be used and/or more complex parameters that relate to strain rate-dependent effects that affect crack growth may be used. Dynamic fracture toughness is a measure of crack growth under dynamic loading. Stress reversals result when loading shifts between compression and tension. Repeated load cycles can result in fatigue. Thus, the application of failure criteria may involve more than simply a stress versus strength metric.

The shock model 110 can incorporate other tools that may have more complex behavior that can affect the model's predictions. For example, advanced gun connectors may be modeled specifically because they exhibit a nonlinear behavior that has a large effect on predictions.

Figure 11:
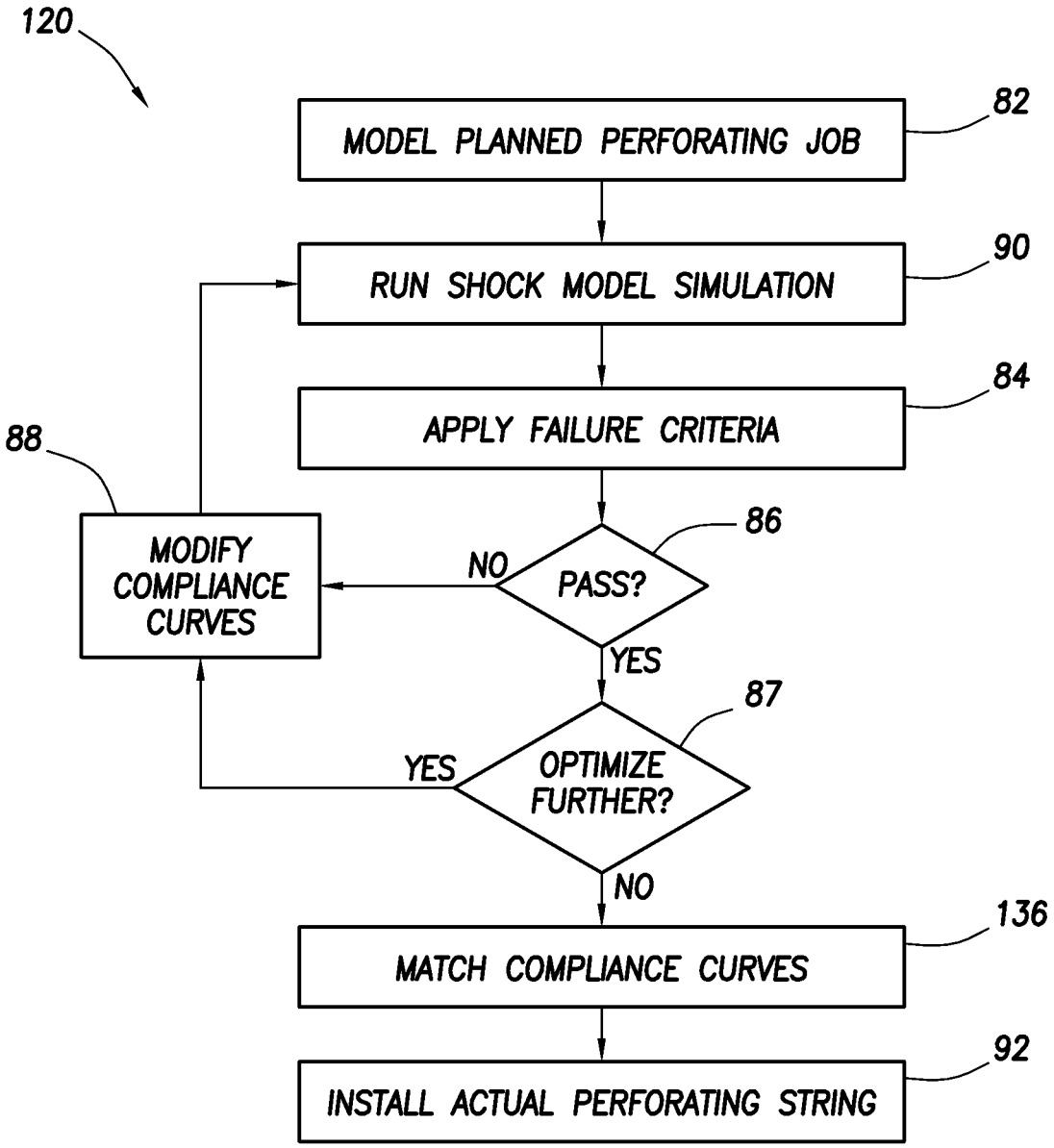
FIG. 11 is a schematic flow chart for a method of mitigating shock produced by well perforating.

Referring additionally now to FIG. 11, a method 120 of mitigating shock produced by well perforating is representatively illustrated in flowchart form. In this example, the method 120 utilizes the shock model 110 to optimize the design of couplers used to prevent (or at least mitigate) transmission of shock through the perforating string 14.

The method 120 can, however, be used to do more than merely optimize the design of a coupler, so that it reduces transmission of shock between elements of a perforating string. For example, by optimizing an array of couplers, the dynamic response of the system can be tuned.

Another general point is that shock transmission can be prevented by simply disconnecting the guns, or essentially maximizing the compliance—but this is not practical due to other considerations of a perforating job. For example, these considerations can include: 1) gun position at the time of firing must be precisely known to get the perforations in the right places in the formation, 2) the string must be solid enough that it can be run into the hole through horizontal deviations etc., and where buckling of connections could be problematic, 3) the tool string must be removed after firing in some jobs and this may involve jarring upward to loosen stuck guns trapped by sand inflow, etc. All of these factors can constrain the design of the coupler and may be factored into the optimization.

Figure 12:
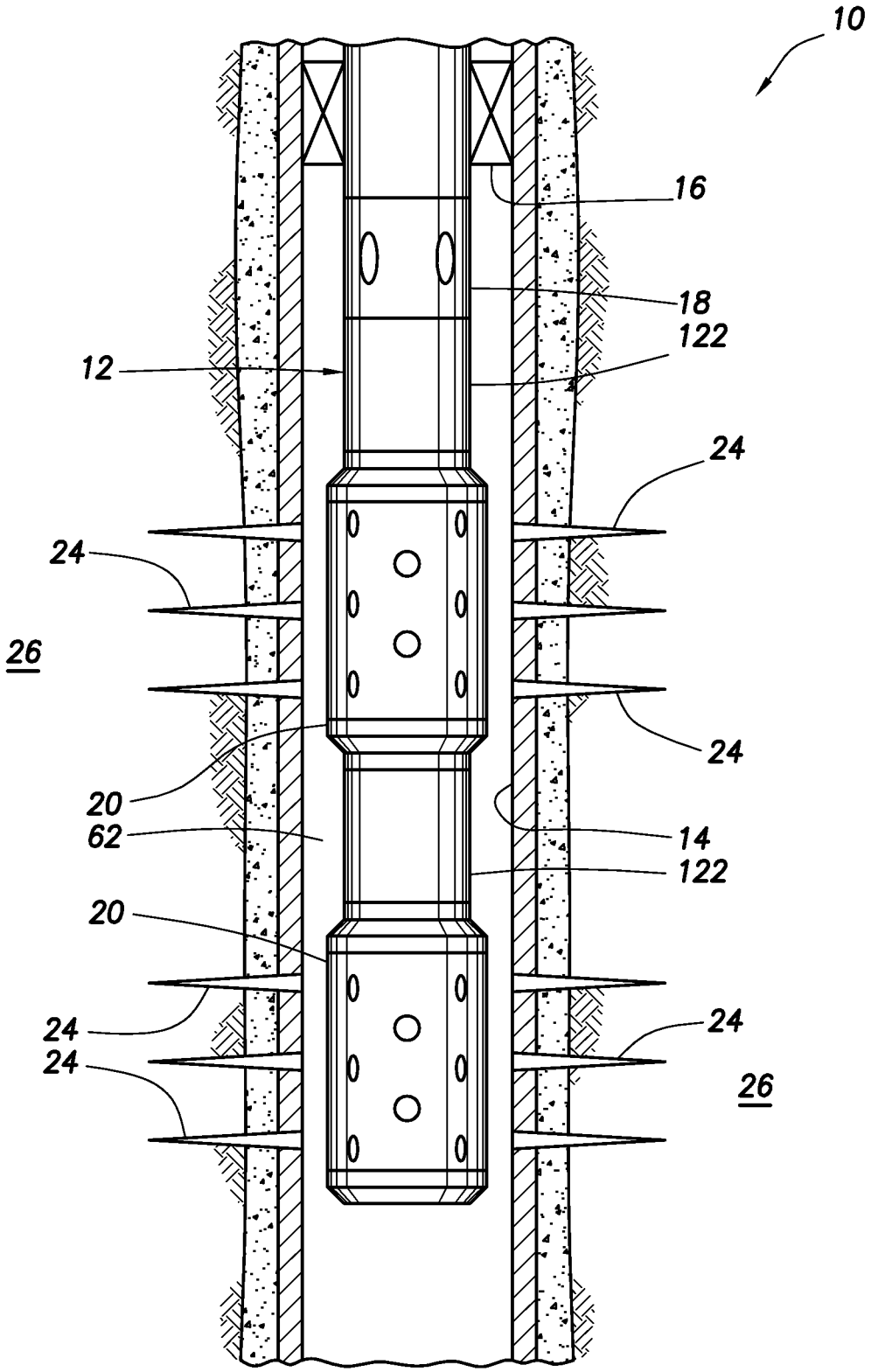
FIG. 12 is a schematic partially cross-sectional view of another configuration of the well system.

In FIG. 12, the well system 10 has been modified to substitute couplers 122 for two of the shock sensing tools 22 in the FIG. 1 configuration. Although it would be useful in some examples for the couplers 122 to occupy positions in the system 10 for which actual perforating effects have been measured by the shock sensing tools 22, it should be understood that it is not necessary in keeping with the scope of this disclosure for the couplers to replace any shock sensing tools in a perforating string.

To validate the performance of the couplers 122, the shock sensing tools 22 can be interconnected in the perforating string 12 with the couplers. In this manner, the effects of the couplers 122 on the shock transmitted through the perforating string 12 can be directly measured.

In the example depicted in FIG. 12, one coupler 122 is positioned between the packer 16 and the upper perforating gun 20 (also between the firing head 18 and the upper perforating gun), and another coupler 122 is positioned between two perforating guns. Of course, other arrangements, configurations, combinations, number, etc., of components may be used in the perforating string 12 in keeping with the scope of this disclosure.

For example, a coupler 122 and/or a shock sensing tool 22 could be connected in the tubular string 12 above the packer 16. The shock sensing tool 22 may be used to measure shock effects above the packer 16, and the coupler 122 may be used to mitigate such shock effects.

Each of the couplers 122 provides a connection between components of the perforating string 12. In the example of FIG. 12, one of the couplers 122 joins the upper perforating gun 20 to the firing head 18, and the other coupler joins the perforating guns to each other.

In actual practice, there may be additional components which join the packer 16, firing head 18 and perforating guns 20 to each other. It is not necessary for only a single coupler 122 to be positioned between the firing head 18 and upper perforating gun 20, or between perforating guns. Accordingly, it should be clearly understood that the scope of this disclosure is not limited by the details of the well system 10 configuration of FIG. 12.

Referring again to the method 120 of FIG. 11, the actual perforating job is modeled in step 82 of the method, similar to this step in the method 80 of FIG. 9. Using the FIG. 12 example, step 82 would preferably include modeling the wellbore 14 and fluid therein, the characteristics of the formation 26 and its communication with the wellbore, and the proposed perforating string 12 (including proposed couplers 122), in three dimensions.

In step 90, a shock model simulation is run. In step 84, failure criteria are applied. These steps, along with further steps 86 (determining whether the perforating string 12 is sufficiently optimized) and step 87 (determining whether further optimization is warranted), are the same as, or similar to, the same steps in the method 80 of FIG. 9.

There are many optimization approaches that could be applied, and many techniques to determine if the optimization is sufficient. For example, a convergence criterion could be applied to a total performance or cost metric. The cost function is very common and it penalizes undesirable attributes of a particular design. Complex approaches can be applied to search for optimal configurations to make sure that the optimizer does not get stuck in a local cost minimum. For example, a wide range of initial conditions (coupler parameters) can be used in an attempt to drive the optimization toward a more global minimum cost.

In step 88, the perforating job is modified by modifying compliance curves of the proposed couplers 122. Each of the couplers 122 has a compliance curve, and the compliance curves of the different couplers are not necessarily the same. For example, the optimization process may indicate that optimal results are obtained when one of the couplers 12 has more or less compliance than another of the couplers.

Compliance is deflection resulting from application of a force, expressed in units of distance/force. "Compliance curve," as used herein, indicates the deflection versus force for a coupler 122. Several representative examples of compliance curves 124 are provided in FIGS. 13A-D.

Figure 13A:
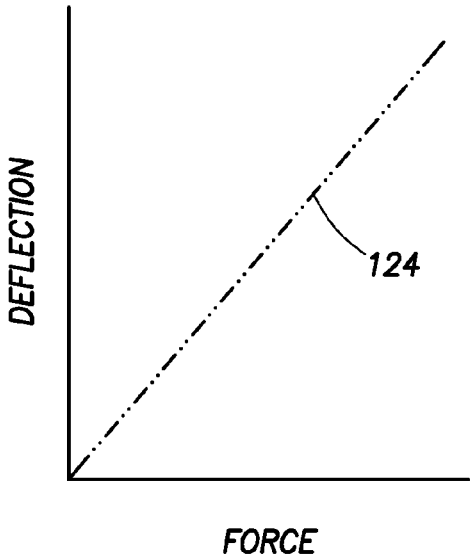
FIGS. 13A-D are schematic graphs of deflection versus force for coupler examples which can embody principles of this disclosure, and which may be used in the well system of FIG. 12.

In FIG. 13A, the compliance curve 124 is linear, that is, a certain change in deflection will result from application of a certain change in force, during operation of a coupler 122 having such a compliance curve. The compliance of the coupler 122 is the slope of the compliance curve 124 (deflection/force) at any point along the curve.

Figure 13B:
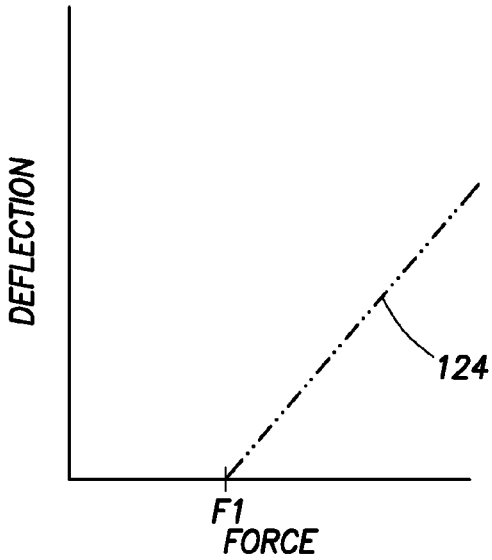

In FIG. 13B, the compliance curve 124 has been modified from its FIG. 13A configuration. In the FIG. 13B configuration, the coupler 122 will have no deflection, until a certain force F1 is exceeded, after which the compliance curve 124 is linear.

The FIG. 13B compliance curve 124 can be useful in preventing any deflection in the coupler 122 until after the perforating string 12 is appropriately installed and positioned in the wellbore 14. The coupler 122 then becomes compliant after the force F1 is applied (such as, upon detonation of the perforating guns 20, tagging a bridge plug, in response to another stimulus, etc.).

Figure 13C:
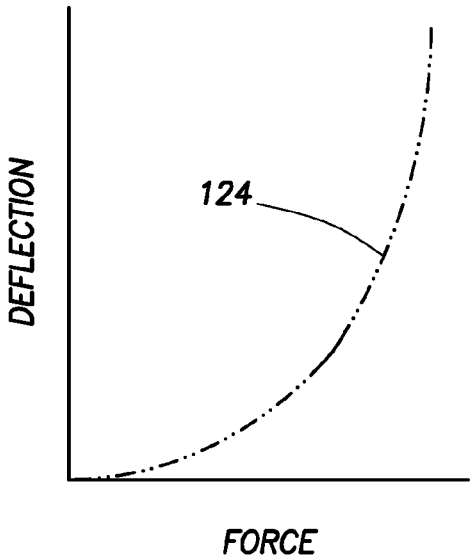

In FIG. 13C, the compliance curve 124 is nonlinear. In this example, the compliance of the coupler 122 increases rapidly as more force is applied. Other functions, relationships between the deflection and force, and shapes of the compliance curve 124 may be used, in keeping with the scope of this disclosure.

Figure 13D:
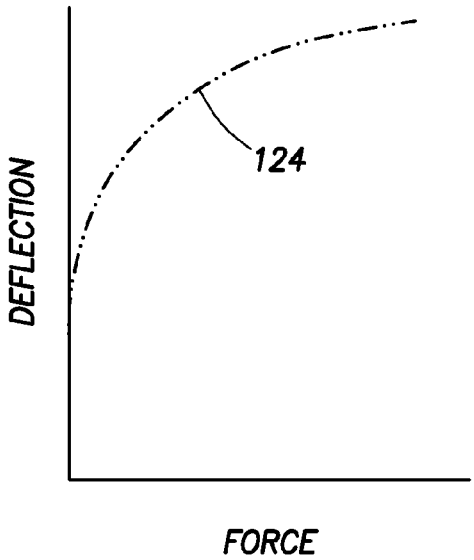

In FIG. 13D, the compliance curve 124 is nonlinear, and the illustration indicates that a certain amount of deflection is permitted in the coupler 122, even without application of any significant force. When substantial force is applied, however, the compliance gradually decreases.

FIGS. 13A-D are merely four examples of a practically infinite number of possibilities for compliance curves 124. Thus, it should be appreciated that the principles of this disclosure are not limited at all to the compliance curves 124 depicted in FIGS. 13A-D.

It will be understood by those skilled in the art that the compliance curve 124 for a coupler 122 can be modified in various ways. A schematic view of a coupler 122 example is representatively illustrated in FIG. 14.

In this example, the coupler 122 is schematically depicted as including a releasing device 126, a damping device 128 and a biasing device 130 interconnected between components 132 of the perforating string 12. The components 132 could be any of the packer 16, firing head 18, perforating guns 20 or any other component of a perforating string.

The releasing device 126 could include one or more shear members, latches, locks, etc., or any other device which can be used to control release of the coupler 122 for permitting relative deflection between the components 132. In the FIG. 14 example, the releasing device 126 includes a shear member 134 which shears in response to application of a predetermined compressive or tensile force to the coupler 122.

This predetermined force may be similar to the force F1 depicted in FIG. 13B, in that, after application of the predetermined force, the coupler 122 begins to deflect. However, it should be understood that any technique for releasing the coupler 122 may be used, and that the releasing device 126 is not necessarily used in the coupler 122, in keeping with the scope of this disclosure.

Figure 14:
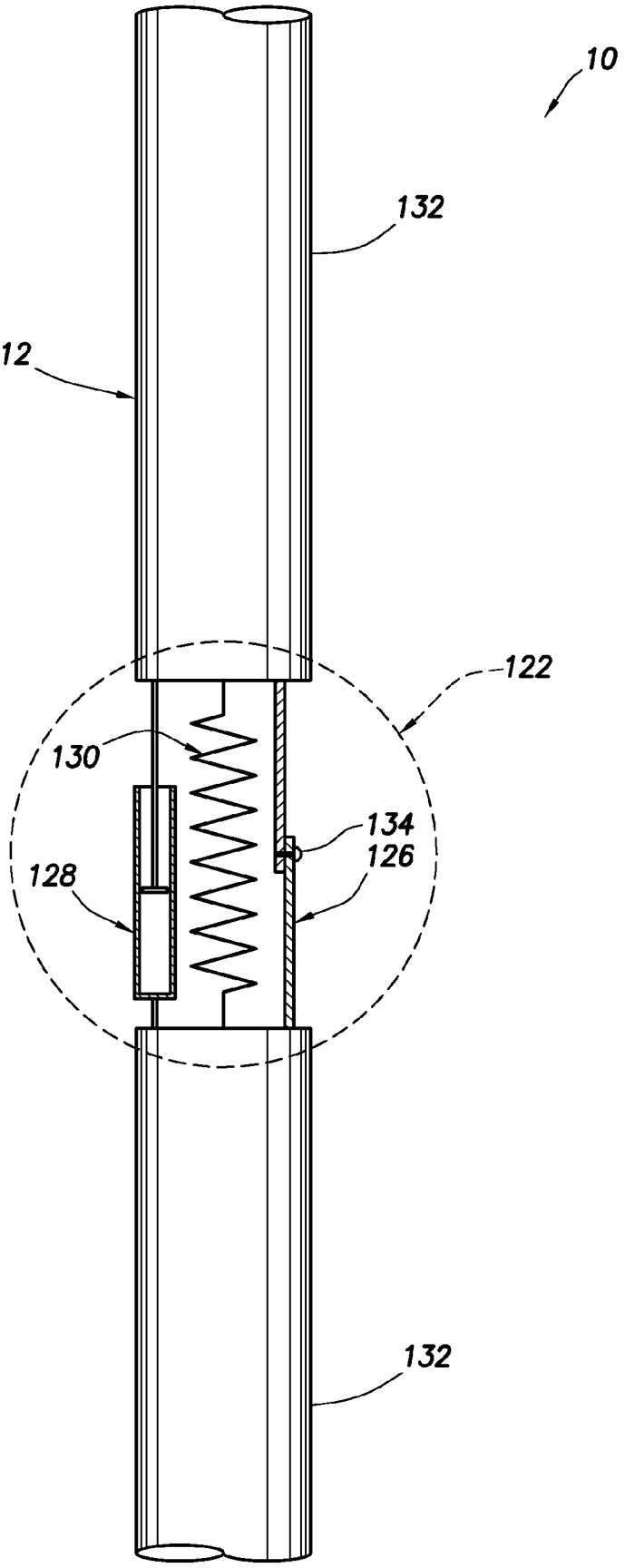
FIG. 14 is a schematic elevational view of a coupler.

The compliance curve 124 for the FIG. 14 coupler 122 may be modified by changing how, whether, when, etc., the releasing device 126 releases. For example, a shear strength of the shear member 134 could be changed, a releasing point of a latch could be modified, etc. Any manner of modifying the releasing device 126 may be used in keeping with the scope of this disclosure.

The damping device 128 could include any means for damping the relative motion between the components 132. For example, a hydraulic damper (e.g., forcing hydraulic fluid through a restriction, etc.), frictional damper, any technique for converting kinetic energy to thermal energy, etc., may be used for the damping device 128. The damping provided by the device 128 could be constant, linear, nonlinear, etc., or even nonexistent (e.g., the damping device is not necessarily used in the coupler 122).

The compliance curve 124 for the FIG. 14 coupler 122 may be modified by changing how, whether, when, etc., the damping device 128 damps relative motion between the components 132. For example, a restriction to flow in a hydraulic damper may be changed, the friction generated in a frictional damper may be modified, etc. Any manner of modifying the damping device 128 may be used in keeping with the scope of this disclosure.

Hydraulic damping is not preferred for this particular application, because of its stroke-rate dependence. With perforating, the stroke should be rapid and at high rate, but viscous and inertial effects of a fluid tend to overly restrict flow in a hydraulic damper. A hydraulic damper would likely not be used between guns 20, when attempting to mitigate gun shock loads, but a hydraulic damper could perhaps be used near the packer 16 to prevent excessive loading of the packer, and to prevent damage to tubing below the packer, since these effects typically occur over a longer timeframe.

The biasing device 130 could include various ways of exerting force in response to relative displacement between the components 132, or in response to other stimulus. Springs, compressed fluids and piezoelectric actuators are merely a few examples of suitable biasing devices.

In this example, the biasing device 130 provides a reactive tensile or compressive force in response to relative displacement between the components 132, but other force outputs and other stimulus may be used in keeping with the scope of this disclosure. The force output by the biasing device 130 could be constant, linear, nonlinear, etc., or even nonexistent (e.g., the biasing device is not necessarily used in the coupler 122).

The compliance curve 124 for the FIG. 14 coupler 122 may be modified by changing how, whether, when, etc., the biasing device 130 applies force to either or both of the components 132. For example, a spring rate of a spring could be changed, a stiffness of a material in the coupler 122 could be modified, etc. Any manner of modifying the biasing device 130 may be used in keeping with the scope of this disclosure.

Figure 15:
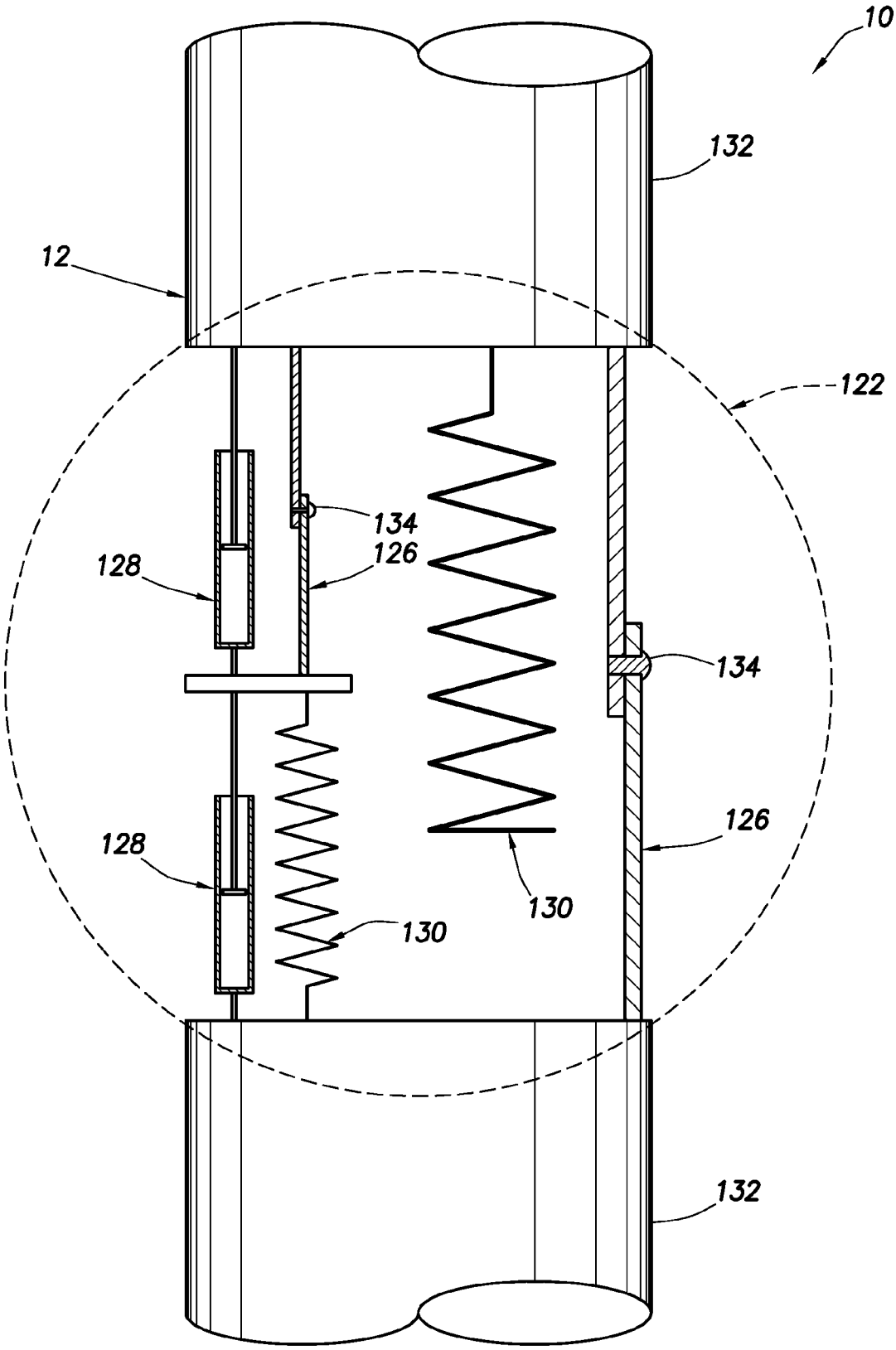
FIG. 15 is a schematic elevational view of another configuration of the coupler.

In FIG. 15, another configuration of the coupler 122 is schematically depicted. This configuration of the coupler 122 demonstrates that more complex versions of the coupler are possible to achieve a desired compliance curve 124. For example, various combinations and arrangements of releasing devices 126, damping devices 128 and biasing devices 130 may be used to produce a compliance curve 124 having a desired shape.

In addition to, or in substitution for, releasing devices 126, biasing devices 130, and damping devices 128, a nonlinear spring may be used that has the effect of a compliance that varies with displacement. Or, an energy absorbing element may be used that has a similar nonlinear behavior. For example, a crushable material could be engaged in compression. The area of contact on the crushable material could be made to change as a function of stroke so that resisting force increases or decreases. When deforming metal, the cross-section of the metal being deformed can be varied along the length to achieve the effect. The effects may be continuous rather than discrete in nature.

In one beneficial use of the principles of this disclosure, the compliance curve 124 can be modified as desired to, for example, optimize a perforating performance metric in the method 120 of FIG. 11. Note that, in step 88 of the method 120, the compliance curves 124 of the couplers 122 are modified if the predictions generated by running the shock model simulation (step 90) do not pass the failure criteria (steps 84, 86). Thus, the compliance curves 124 of the couplers 122 are optimized, so that the predictions generated by running the shock model simulation pass the failure criteria (e.g., predicted performance is maximized, predicted motions are minimized, predicted stresses are minimized, etc. in the perforating string 12, an acceptable margin of safety against structural damage or failure is predicted, etc.).

The method 120 can also include comparing the predictions 116 of the perforating effects, with and without the couplers 122 installed in the perforating string 12. That is, the perforating string model 114 is input to the shock model 110 both with and without the couplers 122 installed in the perforating string 12, and the predictions 116 output by the shock model are compared to each other.

In step 136 of the method 120, the compliance curves 124 of actual couplers 122 are matched to the optimized compliance curves after step 87. This matching step 136 could include designing or otherwise configuring actual couplers 122, so that they will have compliance curves 124 which acceptably match the optimized compliance curves. Alternatively, the matching step 136 could include selecting from among multiple previously-designed couplers 122, so that the selected actual couplers have compliance curves 124 which acceptably match the optimized compliance curves.

In step 92, the actual perforating string 12 having the actual couplers 122 interconnected therein is installed in the wellbore 14. In this example, as a result of the couplers 122 having compliance curves 124 which are optimized for that particular perforating job (e.g., the particular wellbore geometry, perforating string geometry, formation, connectivity, fluids, etc.), perforating job performance is maximized, motions are minimized, stresses are minimized, etc., in the perforating string 12, and an acceptable margin of safety against structural damage or failure is provided, etc. Of course, it is not necessary for any or all of these benefits to be realized in all perforating jobs which are within the scope of this disclosure, but these benefits are contemplated as being achievable by utilizing the principles of this disclosure.

It may now be fully appreciated that the above disclosure provides several advancements to the art. The shock model 110 can be used to predict the effects of a perforating event on various components of the perforating string 12, and to investigate a failure of, or damage to, an actual perforating string. In the method 80 described above, the shock model 110 can also be used to optimize the design of the perforating string 12. In the method 120 described above, couplers 122 in the perforating string 12 can be optimized, so that each coupler has an optimized compliance curve 124 for preventing transmission of shock through the perforating string.

The above disclosure provides to the art a method 120 of mitigating perforating effects produced by well perforating. In one example, the method 120 can include causing a shock model 110 to predict the perforating effects for a proposed perforating string 12, optimizing a compliance curve 124 of at least one proposed coupler 122, thereby mitigating the perforating effects for the proposed perforating string 12, and providing at least one actual coupler 122 having substantially the same compliance curve 124 as the proposed coupler 122.

Causing the shock model 110 to predict the perforating effects may include inputting a three-dimensional model of the proposed perforating string 12 to the shock model 110.

Optimizing the compliance curve 124 may include determining the compliance curve 124 which results in minimized transmission of shock through the proposed perforating string 12, and/or minimized stresses in perforating guns 20 of the perforating string 12.

The optimizing step can include optimizing the compliance curve 124 for each of multiple proposed couplers 122. Of course, it is not necessary for multiple couplers 122 to be used in the perforating string 12.

The compliance curve 124 for one proposed coupler 122 may be different from the compliance curve 124 for another proposed coupler 122, or they may be the same. The compliance curves 124 can vary along the proposed perforating string 12.

The method 120 can also include interconnecting multiple actual couplers 122 in an actual perforating string 12, with the actual couplers 122 having substantially the same compliance curves 124 as the proposed couplers 122.

At least two of the actual couplers 122 may have different compliance curves 124.

The method 120 can include interconnecting multiple actual couplers 122 in an actual perforating string 12, with each of the actual couplers 122 having a respective optimized compliance curve 124. At least one of the actual couplers 122 may be connected in the actual perforating string 12 between perforating guns 20.

Also described above is a well system 10. In one example, the well system 10 can include a perforating string 12 with at least one perforating gun 20 and multiple couplers 122. Each of the couplers 122 has a compliance curve 124, and at least two of the compliance curves 124 are different from each other.

At least one of the couplers 122 may be interconnected between perforating guns 20, between a perforating gun 20 and a firing head 18, between a perforating gun 20 and a packer 16, and/or between a firing head 18 and a packer 16. A packer 16 may be interconnected between at least one of the couplers 122 and a perforating gun 20.

The couplers 122 preferably mitigate transmission of shock through the perforating string 12.

The coupler compliance curves 124 may substantially match optimized compliance curves 124 generated via a shock model 110.

This disclosure also provides to the art a method 120 of mitigating perforating effects produced by well perforating. In one example, the method 120 can include interconnecting multiple couplers 122 spaced apart in a perforating string 12, each of the couplers 122 having a compliance curve 124. The compliance curves 124 are selected based on predictions by a shock model 110 of perforating effects generated by firing the perforating string 12.

The method 120 can include inputting a three-dimensional model of the proposed perforating string 12 to the shock model 110.

The method 120 can include determining the compliance curves 124 which result in minimized transmission of shock through the perforating string 12.

The compliance curve 124 for one of the couplers 122 may be different from the compliance curve 124 for another of the couplers 122. The compliance curves 124 may vary along the perforating string 12. At least two of the couplers 122 may have different compliance curves 124.

At least one of the couplers 122 may be connected in the perforating string 12 between perforating guns 20. A packer 16 may be interconnected between the coupler 122 and a perforating gun 20.

The method 120 can include comparing the perforating effects predicted by the shock model 110 both with and without the proposed coupler 122 in the perforating string 12.

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the present invention being limited solely by the appended claims and their equivalents.

What is claimed is:

1. A well system, comprising:

a perforating string including at least one perforating gun and multiple couplers, each of the couplers having a compliance curve, and at least two of the compliance curves being different from each other, wherein the coupler compliance curves are optimized using a shock model.

2. The well system of claim 1, wherein at least one of the couplers is interconnected between first and second perforating guns.

3. The well system of claim 1, wherein at least one of the couplers is interconnected between the perforating gun and a firing head.

4. The well system of claim 1, wherein at least one of the couplers is interconnected between the perforating gun and a packer.

5. The well system of claim 1, wherein at least one of the couplers is interconnected between a firing head and a packer.

6. The well system of claim 1, wherein a packer is interconnected between at least one of the couplers and the perforating gun.

7. The well system of claim 1, wherein the couplers mitigate transmission of shock through the perforating string.

8. The well system of claim 1, wherein the optimization of the coupler compliance curves comprises running at least one shock model simulation of the perforating string.

* * * * *